US008925504B2

(12) United States Patent
Tsuzuki et al.

(10) Patent No.: US 8,925,504 B2
(45) Date of Patent: Jan. 6, 2015

(54) VARIABLE VALVE OPERATING APPARATUS FOR INTERNAL COMBUSTION ENGINE

(75) Inventors: Motohiro Tsuzuki, Nisshin (JP); Shinobu Shimasaki, Toyoto (JP); Akio Kidooka, Ashigarakami-gun (JP); Hirotaka Sunada, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 111 days.

(21) Appl. No.: 13/389,540

(22) PCT Filed: Jun. 7, 2010

(86) PCT No.: PCT/JP2010/059619

§ 371 (c)(1),
(2), (4) Date: Feb. 8, 2012

(87) PCT Pub. No.: WO2011/065042

PCT Pub. Date: Jun. 3, 2011

(65) Prior Publication Data

US 2012/0138002 A1 Jun. 7, 2012

(30) Foreign Application Priority Data

Nov. 25, 2009 (WO) ..... PCT/JP2009/069852

(51) Int. Cl.

| | |
|---|---|
| ***F01L 1/34*** | (2006.01) |
| ***F01L 1/18*** | (2006.01) |
| ***F01L 1/26*** | (2006.01) |
| *F01L 13/00* | (2006.01) |

(52) U.S. Cl.

CPC . *F01L 1/26* (2013.01); *F01L 1/185* (2013.01); *F01L 2013/0052* (2013.01); *F01L 13/0036* (2013.01); *F01L 2105/00* (2013.01); *F01L 13/0021* (2013.01)

USPC ..... 123/90.16

(58) Field of Classification Search

USPC ..... 123/90.15–90.18

See application file for complete search history.

(56) References Cited

U.S. PATENT DOCUMENTS

| | | | |
|---|---|---|---|
| 2,843,095 | A | 7/1958 | Prentice |
| 5,353,756 | A | 10/1994 | Murata et al. |

(Continued)

FOREIGN PATENT DOCUMENTS

| | | | |
|---|---|---|---|
| DE | 42 30 877 | A1 | 4/1993 |
| DE | 199 45 340 | A1 | 3/2001 |

(Continued)

OTHER PUBLICATIONS

International Search Report issued on Sep. 28, 2010 in PCT/JP10/059619 filed on Jun. 7, 2010.

(Continued)

*Primary Examiner* — Thomas Denion
*Assistant Examiner* — Steven D Shipe
(74) *Attorney, Agent, or Firm* — Oblon, Spivak, McClelland, Maier & Neustadt, L.L.P.

(57) ABSTRACT

Provided is a variable valve operating apparatus for an internal combustion engine, which can switch, based on an actuation of a single actuator, operating characteristics of valves for a plurality of cylinders collectively and smoothly using a rigid member, while suppressing an increase in wear of a guide rail and reducing the number of delay mechanisms.

A changeover mechanism to switch operating characteristics of valves for each cylinder of first and second cylinder groups is provided. The changeover mechanism includes link shafts as a rigid member which is displaced when being engaged with a helical guide rail as a result of the actuation of an electromagnetic solenoid. The changeover mechanism includes a delay mechanism, which delays the displacement of the second link shaft in a cylinder in which the valves are lifting when the electromagnetic solenoid is actuated, at some point in the link shafts between the first cylinder group and the second cylinder group.

13 Claims, 19 Drawing Sheets

(56) References Cited

U.S. PATENT DOCUMENTS

| | | | | |
|---|---|---|---|---|
| 5,785,017 | A | 7/1998 | Saito et al. | |
| 7,415,954 | B2 | 8/2008 | Falkowski et al. | |
| 8,166,941 | B2 | 5/2012 | Werler | |
| 8,186,318 | B2 | 5/2012 | Sunada et al. | |
| 8,191,520 | B2 | 6/2012 | Kidooka et al. | |
| 8,230,833 | B2 * | 7/2012 | Werler et al. | 123/90.6 |
| 8,251,028 | B2 | 8/2012 | Ezaki et al. | |
| 8,286,600 | B2 * | 10/2012 | Riley et al. | 123/90.16 |
| 8,443,588 | B2 | 5/2013 | Nishikiori et al. | |
| 8,468,988 | B2 | 6/2013 | Nishikiori et al. | |
| 8,622,035 | B2 | 1/2014 | Meintschel et al. | |
| 2005/0011480 | A1 | 1/2005 | Schultz et al. | |
| 2006/0283412 | A1 * | 12/2006 | Tsuruta et al. | 123/90.16 |
| 2007/0034184 | A1 | 2/2007 | Dengler | |
| 2009/0025666 | A1 | 1/2009 | Tateno et al. | |
| 2009/0277407 | A1 * | 11/2009 | Ezaki | 123/90.15 |
| 2010/0126447 | A1 | 5/2010 | Talan et al. | |
| 2010/0139594 | A1 * | 6/2010 | Wutzler et al. | 123/90.17 |
| 2011/0079191 | A1 * | 4/2011 | Lengfeld et al. | 123/90.18 |
| 2011/0088642 | A1 | 4/2011 | Ezaki | |
| 2011/0126786 | A1 | 6/2011 | Kidooka et al. | |
| 2011/0214636 | A1 | 9/2011 | Sunada et al. | |
| 2011/0271917 | A1 | 11/2011 | Ezaki et al. | |
| 2012/0055428 | A1 | 3/2012 | Kidooka | |
| 2012/0138001 | A1 * | 6/2012 | Werler et al. | 123/90.18 |
| 2012/0222635 | A1 | 9/2012 | Sunada et al. | |

FOREIGN PATENT DOCUMENTS

| | | | |
|---|---|---|---|
| JP | 08 312318 | | 11/1996 |
| JP | 8-338213 | A | 12/1996 |
| JP | 10-8928 | A | 1/1998 |
| JP | 10 196334 | | 7/1998 |
| JP | 2003 120375 | | 4/2003 |
| JP | 2003120375 | A * | 4/2003 |
| JP | 2006 520869 | | 9/2006 |
| JP | 2009 180142 | | 8/2009 |
| JP | 2009-228543 | A | 10/2009 |
| JP | 2009 293613 | | 12/2009 |
| JP | 2010 096142 | | 4/2010 |
| JP | 2010 275935 | | 12/2010 |
| WO | 2009 136551 | | 11/2009 |

OTHER PUBLICATIONS

Office Action mailed Apr. 24, 2014, in co-pending U.S. Appl. No. 13/500,671.

Office Action mailed Jan. 30, 2014, in co-pending U.S. Appl. No. 13/500,671.

Office Action issued in U.S. Appl. No. 13/500,671 on Sep. 2, 2014.

* cited by examiner

VARIABLE VALVE OPERATING APPARATUS FOR INTERNAL COMBUSTION ENGINE

TECHNICAL FIELD

The present invention relates to a variable valve operating apparatus for an internal combustion engine.

BACKGROUND ART

So far, for example, Patent Document 1 discloses a variable valve operating apparatus for an internal combustion engine in which a cam carrier provided with two kinds of cams is provided for each cylinder, and, during a base-circle section of the two kinds of cams, the cam carrier is moved in the axial direction with respect to a cam main-shaft which is rotated, so that valve drive cams for each cylinder are switched. To be more specific, in this conventional variable valve operating apparatus, guide grooves which are formed into a helical shape are provided respectively in both ends of the outer peripheral surface of each cam carrier. Moreover, an electric actuator, which drives a drive pin to be inserted into or removed from the guide groove, is provided for each guide groove. Furthermore, the above-described conventional variable valve operating apparatus is applied with respect to a straight four-cylinder engine.

According to the above-described conventional variable valve operating apparatus, the cam carrier is displaced with respect to the axial direction thereof by engaging the drive pin to which the axial position of the camshaft is fixed with the guide groove. As a result of this, the valve drive cams for each cylinder are switched, and the lift amounts of valves can be therefore changed.

Moreover, for example, Patent Document 2 discloses a diesel engine equipped with a variable valve operating apparatus for changing operating characteristics of an intake valve. This conventional variable valve operating apparatus includes a gas pressure type actuator using a gas pressure. This gas pressure type actuator moves one control rod (link shaft) and a control plate (link arm) for each cylinder coupled therewith in the axial direction thereof, and thereby the operating characteristics of the valves for all cylinders are collectively changed.

Including the above mentioned document, the applicant is aware of the following documents as a related art of the present invention.

CITATION LIST

Patent Documents

[Patent Document 1] Japanese National Publication of International Patent Application No. 2006-520869

[Patent Document 2] Japanese Laid-open Patent Application Publication No. 2003-120375

[Patent Document 3] Japanese Laid-open Patent Application Publication No. Hei 10-196334

SUMMARY OF INVENTION

Technical Problem

The variable valve operating apparatus disclosed by above-described Patent Document 1 requires two electrically driven actuators per one cylinder with respect to one camshaft, in order to switch the operating characteristics of a valve for each cylinder. In this way, if the number of the actuators that is required increases, a cost of the variable valve operating apparatus increases. Therefore, it is desired to achieve the variable valve operating apparatus that can switch the operating characteristics of a valve for each cylinder while decreasing the number of the actuators which are installed.

Accordingly, one possible idea would be to have an arrangement made such that in the above-described conventional variable valve operating apparatus, the cam carriers for each cylinder are linked with each other and the cams for all cylinders are collectively switched as a result of the actuation of a single electric actuator. If, however, a general operating angle of the valve is set in a straight four-cylinder engine to which the conventional variable valve operating apparatus is applied, there is no common base-circle section of the cams relating to all cylinders. Therefore, it becomes difficult to smoothly switch the operating characteristics of the valves for each cylinder if an attempt is made to collectively switch, as a result of the actuation of the single electric actuator, the cams for all cylinders by displacing a connecting body of the cam carriers that is a rigid member.

On the other hand, according to the variable valve operating apparatus according to above-described Patent Document 2, the operating characteristics of the valves for all cylinders can be collectively changed using a single gas pressure type actuator. More specifically, in order to smoothly switch the operating characteristics of the valves for each cylinder, in the conventional variable valve operating apparatus, springs for biasing the control plate are provided for all cylinders. Such configuration, however, makes the number of components large. In the meantime, if the number of cylinders for which a part corresponding to the above-mentioned spring of the variable valve operating apparatus in above-described Patent Document 2 is provided is decreased without any consideration, switching the operating characteristics of valves for a plurality of cylinders in a short common base-circle section is required. Therefore, in a case of a variable valve operating apparatus having a configuration in which the operating characteristics of valves for all cylinders are collectively switched using a helical guide rail, the helix of the guide rail becomes acute, and thus there is a concern that wear of the guide rail increases.

The present invention has been made to solve the problem as described above, and has its object to provide a variable valve operating apparatus for an internal combustion engine, which can switch, based on an actuation of a single actuator, operating characteristics of valves for a plurality of cylinders collectively and smoothly using a rigid member, while suppressing an increase in wear of a guide rail and reducing the number of delay mechanisms.

Solution to Problem

A first aspect of the present invention is a variable valve operating apparatus for an internal combustion engine that has a first cylinder group made up of a plurality of cylinders lying side by side and a second cylinder group made up of another plurality of cylinders lying side by side, and has an explosion order which is set in such a way that a common base-circle section of a cam is present relating to the plurality of cylinders belonging to the first cylinder group and another common base-circle section of a cam is present relating to the another plurality of cylinders belonging to the second cylinder group, the variable valve operating apparatus comprising:

a transfer member which is disposed between the cam and a valve in each cylinder of the first cylinder group and the second cylinder group, and transfers an acting force of the cam to the valve; and a changeover mechanism which changes operational states of the transfer member to switch operating characteristics of the valve provided for each cylinder of the first cylinder group and the second cylinder group, wherein the changeover mechanism includes:

an actuator which is shared for each cylinder of the first cylinder group and the second cylinder group, and is driven when the operational states of the transfer member in each cylinder of the first cylinder group and the second cylinder group are switched;

a guide rail which is of helical shape and is provided in an outer peripheral surface of a camshaft to which the cam is attached;

a rigid member which is displaced when being engaged with the guide rail as a result of an actuation of the actuator to switch the operational states of the transfer member provided for each cylinder of the first cylinder group and the second cylinder group; and a delay mechanism which delays an displacement of the rigid member in a cylinder in which the valve is lifting when the actuator is actuated, and wherein the delay mechanism is interposed at some point in the rigid member between the first cylinder group and the second cylinder group.

A second aspect of the present invention is the variable valve operating apparatus for an internal combustion engine according to the first aspect of the present invention, wherein the transfer member is rocker arms provided for each cylinder of the first cylinder group and the second cylinder group, and includes a first rocker arm which oscillates in synchronization with the cam and a second rocker arm which can press the valve, wherein the rigid member includes:

a member connecting shaft which is disposed inside a rocker shaft supporting the first rocker arm and the second rocker arm in such a way as to be displaceable in its axial direction; and a displacement member which is provided for each cylinder of the first cylinder group and the second cylinder group, each of which is connected to the member connecting shaft, and is displaced along with the member connecting shaft as a result of an actuation of the actuator to change the operational states of the second rocker arm for each cylinder of the first cylinder group and the second cylinder group, and wherein the delay mechanism is interposed at some point in the member connecting shaft inside the rocker shaft.

A third aspect of the present invention is the variable valve operating apparatus for an internal combustion engine according to the second aspect of the present invention, wherein the variable valve operating apparatus further comprises a changeover pin which is disposed so as to be movable with respect to a pin hole formed in each of the first rocker arm and the second rocker arm, and which is displaced in conjunction with a displacement of the displacement member, and wherein the displacement of the displacement member switches between a connection state in which the first rocker arm and the second rocker arm are in connection via the changeover pin and a disconnection state in which the connection is released A fourth aspect of the present invention is the variable valve operating apparatus for an internal combustion engine according to the second or third aspect of the present invention, wherein the displacement member includes:

a main displacement member which has an engaging part engageable and disengageable with the guide rail, and is displaceable in the axial direction of the camshaft; and a sub displacement member which is provided for each remaining cylinder, for which the main displacement member is not provided, out of all cylinders of the first cylinder group and the second cylinder group, and is displaced in conjunction with the main displacement member via the member connecting shaft, wherein the actuator generates a driving force for engaging the engaging part with the guide rail, wherein when the actuator is actuated, the engaging part is engaged with the guide rail as a result of the main displacement member being rotated about the member connecting shaft, and wherein the operational states of the second rocker arm for the cylinder for which the main displacement member is provided are changed as a result of a displacement of the main displacement member that takes place during engagement between the engaging part and the guide rail, and the operational states of the second rocker arm for the each remaining cylinder for which the sub displacement member is provided are changed as a result of displacements of the member connecting shaft and the sub displacement member in conjunction with the displacement of the main displacement member.

A fifth aspect of the present invention is the variable valve operating apparatus for an internal combustion engine according to the third or fourth aspect of the present invention, wherein the variable valve operating apparatus switches the first rocker arm and the second rocker arm from the connection state to the disconnection state as a result of the displacement member, which abuts on the changeover pin, pressing the changeover pin, wherein the variable valve operating apparatus further comprises biasing means which biases at least one of the member connecting shaft and the displacement member toward a direction to return to the connection state, wherein at a time of a return to the connection state, the actuator is driven to release a state in which the member connecting shaft and the displacement member are held so as not to be displaced by a biasing force generated by the biasing means, and wherein the variable valve operating apparatus further comprises restricting means which restricts a displacement of the member connecting shaft in such a way that when the actuator is actuated to return to the connection state, the operational states of the first and second rocker arms in another cylinder(s) are not returned to the connection state before the operational states of the first and second rocker arms in a return start target cylinder to the connection state are returned to the connection state.

A sixth aspect of the present invention is the variable valve operating apparatus for an internal combustion engine according to the fifth aspect of the present invention, wherein the restricting means is provided in a plurality of cylinders, which are cylinders except for the last cylinder in explosion order with respect to the return start target cylinder and in which the explosion order is successive.

A seventh aspect of the present invention is the variable valve operating apparatus for an internal combustion engine according to the second or third aspect of the present invention, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein the displacement member includes:

a first main displacement member which has a first engagement part being engageable and disengageable with the first guide rail, is integrally coupled with the first member connecting shaft, and is rotatably supported by the rocker shaft;

a first sub displacement member which is provided for each remaining cylinder without the first main displacement member in the first cylinder group, and is displaced in conjunction with the first main displacement member via the first member connecting shaft;

a second main displacement member which has a second engagement part being engageable and disengageable with the second guide rail, is integrally coupled with the second member connecting shaft, and is rotatably supported by the rocker shaft; and a second sub displacement member which is provided for each remaining cylinder without the second main displacement member in the second cylinder group, and is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating with the member connecting shaft, wherein the operational states of the second rocker arm for the cylinder for which the first main displacement member is provided are changed as a displacement of the first main displacement member takes place during the engagement between the first engaging part and the first guide rail, and the operational states of the second rocker arm for the each remaining cylinder for which the first sub displacement member is provided are changed as displacements of the first member connecting shaft and the first sub displacement member in conjunction with the displacement of the first main displacement member, wherein the delay mechanism is a mechanism which transfers a rotational force of the first member connecting shaft taking place during the engagement between the first engaging part and the first guide rail, into the second member connecting shaft with a delay, wherein when the rotational force of the first member connecting shaft is transferred into the second member connecting shaft via the delay mechanism, the second engagement part engages with the second guide rail as a result of a rotation of the second main displacement member with the second member connecting shaft, and wherein the operational states of the second rocker arm for the cylinder for which the second main displacement member is provided are changed as a displacement of the second main displacement member takes place during the engagement between the second engaging part and the second guide rail, and the operational states of the second rocker arm for the each remaining cylinder for which the second sub displacement member is provided are changed as displacements of the second member connecting shaft and the second sub displacement member in conjunction with the displacement of the second main displacement member.

An eighth aspect of the present invention is the variable valve operating apparatus for an internal combustion engine according to the seventh aspect of the present invention, wherein the delay mechanism includes a torsion spring for transferring the rotational force of the first member connecting shaft into the second member connecting shaft with a delay.

A ninth aspect of the present invention is the variable valve operating apparatus for an internal combustion engine according to the first aspect of the present invention, wherein the transfer member is rocker arms provided for each cylinder of the first cylinder group and the second cylinder group, and includes a first rocker arm which oscillates in synchronization with the cam and a second rocker arm which can press the valve, wherein the rigid member includes:

a member connecting shaft which is disposed inside a rocker shaft supporting the first rocker arm and the second rocker arm in such a way as to be displaceable in its axial direction; and a displacement member which is provided for each cylinder of the first cylinder group and the second cylinder group, each of which is connected to the member connecting shaft, and is displaced along with the member connecting shaft as a result of an actuation of the actuator to change the operational states of the second rocker arm for each cylinder of the first cylinder group and the second cylinder group, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein the displacement member includes:

a first main displacement member which has a first engagement part being engageable and disengageable with the first guide rail, and is rotatably supported by the rocker shaft;

a first sub displacement member which is provided for each remaining cylinder without the first main displacement member in the first cylinder group, and is displaced in conjunction with the first main displacement member via the first member connecting shaft;

a second main displacement member which has a second engagement part being engageable and disengageable with the second guide rail, and is rotatably supported by the rocker shaft; and a second sub displacement member which is provided for each remaining cylinder without the second main displacement member in the second cylinder group, and is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating, wherein the operational states of the second rocker arm for the cylinder for which the first main displacement member is provided are changed as a displacement of the first main displacement member takes place during the engagement between the first engaging part and the first guide rail, and the operational states of the second rocker arm for the each remaining cylinder for which the first sub displacement member is provided are changed as displacements of the first member connecting shaft and the first sub displacement member in conjunction with the displacement of the first main displacement member, wherein the delay mechanism is a mechanism which rotates the second main displacement member by use of the displacement of the first member connecting shaft taking place during the engagement between the first engaging part and the first guide rail and thereby rotates the second main displacement member at a timing later than that at the first main displacement member, wherein when the second main displacement member is rotated, the second engagement part is engaged with the second guide rail, and wherein the operational states of the second rocker arm for the cylinder for which the second main displacement member is provided are changed as a displacement of the second main displacement member takes place during the engagement between the second engaging part and the second guide rail, and the operational states of the second rocker arm for the each remaining cylinder for which the second sub displacement member is provided are changed as displacements of the second member connecting shaft and the second sub displacement member in conjunction with the displacement of the second main displacement member.

A tenth aspect of the present invention is the variable valve operating apparatus for an internal combustion engine according to the ninth aspect of the present invention, wherein the delay mechanism includes:

a first tapered surface which is formed on the first member connecting shaft or a first fixing member fixed thereto in such a way that its width narrows toward the second main displacement member side; and a second tapered surface which is formed on the second main displacement member or a second fixing member fixed thereto and abuts on the first tapered surface, and wherein as the first tapered surface is displaced toward the second tapered surface as a result of the displacement of the first member connecting shaft, the first tapered surface presses the second tapered surface to rotate the second main displacement member.

An eleventh aspect of the present invention is the variable valve operating apparatus for an internal combustion engine according to the ninth aspect of the present invention, wherein the delay mechanism includes:

a guide pin which is displaced in conjunction with the first member connecting shaft;

a guide groove which is formed in a peripheral surface of the rocker shaft and guides the guide pin; and an engagement groove which is formed in the second main displacement member and is engaged with the guide pin, and wherein the guide groove and the engagement groove are grooves that function in order to rotate the second main displacement member as a result of a displacement of the guide pin associated with the displacement of the first member connecting shaft.

A twelfth aspect of the present invention is the variable valve operating apparatus for an internal combustion engine according to the eleventh aspect of the present invention, wherein a holding part of the engagement groove is engaged with the guide pin at a position at which the second member connecting shaft has been displaced during the engagement between the second engagement part and the second guide rail, and thereby an axial position of the second member connecting shaft is held.

A thirteenth aspect of the present invention is the variable valve operating apparatus for an internal combustion engine according to the second or third aspect of the present invention, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein the displacement member includes:

a first main displacement member which has a first engagement part being engageable and disengageable with the first guide rail, and is rotatably supported by the rocker shaft;

a first sub displacement member which is provided for each remaining cylinder without the first main displacement member in the first cylinder group, and is displaced in conjunction with the first main displacement member via the first member connecting shaft;

a second main displacement member which has a second engagement part being engageable and disengageable with the second guide rail, and is rotatably supported by the rocker shaft; and a second sub displacement member which is provided for each remaining cylinder without the second main displacement member in the second cylinder group, and is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating, wherein the operational states of the second rocker arm for the cylinder for which the first main displacement member is provided are changed as a displacement of the first main displacement member takes place during the engagement between the first engaging part and the first guide rail, and the operational states of the second rocker arm for the each remaining cylinder for which the first sub displacement member is provided are changed as displacements of the first member connecting shaft and the first sub displacement member in conjunction with the displacement of the first main displacement member, wherein the delay mechanism includes a deformable member, one end of which functions as the second engagement part of the second main displacement member, the other end of which is abuttable with the first member connecting shaft, and which has a flexible part that passes through insides of the second member connecting shaft and the second main displacement member, wherein the deformable member is displaced as a result of the displacement of the first member connecting shaft taking place during the engagement between the first engaging part and the first guide rail, and thereby the second engagement part is engaged with the second guide rail at a timing later than a timing when the first engagement part is engaged with the first guide rail, and wherein the operational states of the second rocker arm for the cylinder for which the second main displacement member is provided are changed as a displacement of the second main displacement member takes place during the engagement between the second engaging part and the second guide rail, and the operational states of the second rocker arm for the each remaining cylinder for which the second sub displacement member is provided are changed as displacements of the second member connecting shaft and the second sub displacement member in conjunction with the displacement of the second main displacement member.

A fourteenth aspect of the present invention is the variable valve operating apparatus for an internal combustion engine according to the thirteenth aspect of the present invention, wherein the variable valve operating apparatus of the internal combustion engine further comprises:

a ball plunger which is provided inside the second main displacement member; and a lock groove which is provided on the deformable member and is engageable with the ball plunger, and wherein in a state in which the second engagement part is taken out from the second guide rail after the displacement of the second member connecting shaft as a result of the engagement between the second engagement part and the second guide rail is performed, the ball plunger is engaged with the lock groove and the other end of the deformable member abuts on the first member connecting shaft, and thereby an axial position of the second member connecting shaft is held.

Advantageous Effects of Invention

According to the first aspect of the present invention, the delay mechanism is interposed at some point in the rigid member between the first cylinder group and the second cylinder group, in the variable valve operating apparatus that is applied to the internal combustion engine having the first cylinder group made up of a plurality of cylinders lying side by side and the second cylinder group made up of another plurality of cylinders lying side by side, and having the explosion order which is set in such a way that the common base-circle sections of the cams are present as described above. Such configuration makes it possible to ensure well-balanced common base-circle sections of the cams in both of the first cylinder group and the second cylinder group, compared with the case in which a delay mechanism is interposed at some point in the rigid member between a cylinder group made up of a plurality of cylinders and a single cylinder. Therefore, the rigid member can be displaced with enough margin when the rigid member is displaced as a result of an actuation of the actuator. Moreover, in a case in which the configuration is made such that the rigid member is displaced using a guide rail of helical shape as in the present invention, a guide rail having a gentle slant becomes able to be used, and thereby the increase of a contact load between the guide rail and an engagement part of the rigid member can be prevented. As described above, according to the present invention, it becomes possible to switch, based on an actuation of the single actuator, the operating characteristics of valves for a plurality of cylinders collectively and smoothly using the rigid member, while suppressing an increase in wear of the guide rail and reducing the number of delay mechanisms.

According to the second aspect of the present invention, the delay mechanism is disposed at some point in the member connecting shaft inside the rocker shaft supporting the first rocker arm and the second rocker arm. Therefore, the present invention makes it possible to include the delay mechanism without requiring a new room.

According to the third aspect of the present invention, it becomes possible to switch, based on an actuation of the single actuator, the operating characteristics of the valves for a plurality of cylinders collectively and smoothly using the rigid member, in the variable valve operating apparatus having a configuration to switch between the connection state in which the first rocker arm is connected with the second rocker arm, and the disconnection state in which this connection is released.

According to the fourth aspect of the present invention, it becomes possible to switch, based on an actuation of the single actuator, the operating characteristics of the valves for a plurality of cylinders collectively and smoothly using the rigid member, in the variable valve operating apparatus having a configuration to change the operational states of the second rocker arm using the engagement and disengagement of the engagement part of the main displacement member, with respect to the guide rail provided in the camshaft.

The fifth aspect of the present invention having the restricting means makes it possible to prevent the operational states of the first and second rocker arms in another cylinder(s) from not returning to the connection state by the biasing force generated by the biasing means, before the operational states of the first and second rocker arms in the return start target cylinder to the connection state returns to the connection state when the actuator is actuated to return to the connection state. Therefore, According to the present invention, it becomes possible to perform the returning from a particular cylinder, while enlarging the range allowing a variation of response of the actuator at the time of the return from the connection state.

According to the sixth aspect of the present invention, by being equipped with the restricting means in a plurality of cylinders, which are cylinders except for the last cylinder in explosion order with respect to the return start target cylinder and in which the explosion order is successive, the range allowing a variation of response of the actuator can be ensured long at the time of the return from the connection state.

According to the seventh aspect of the present invention, the number of the guide rails can be increased without increasing the number of the actuators. Further, in the variable valve operating apparatus that includes the single actuator and one guide rail provided for each of both the cylinder groups, the operating characteristics of the valves for a plurality of cylinders can be switched collectively and smoothly, while reducing the contact loads between the respective guide rails and the respective engagement parts.

According to the eighth aspect of the present invention, the use of the torsion spring allows the rotational force of the first member connecting shaft to be surely transferred to the second member connecting shaft with a delay.

According to the ninth aspect of the present invention, the number of the guide rails can be increased without increasing the number of the actuators. Further, in the variable valve operating apparatus that includes the single actuator and one guide rail provided for each of both the cylinder groups, the operating characteristics of the valves for a plurality of cylinders can be switched collectively and smoothly, while reducing the contact loads between the respective guide rails and the respective engagement parts. Moreover, According to the present invention, the second main displacement member can be rotated using the displacement of the first member connecting shaft that is generated from the rotational force of the cam. Therefore, energy for twisting the torsion coil spring is not required in contrast to the above-described eighth aspect of the present invention. As a result, the driving force of the actuator can be reduced compared with the eighth aspect of the present invention.

According to the tenth aspect of the present invention, the use of actions of the first and second tapered surfaces allows the displacement of the first member connecting shaft to be converted to the rotation of the second main displacement member with a delay.

According to the eleventh aspect of the present invention, the use of actions of the guide groove, the guide pin and the engagement groove allows the displacement of the first member connecting shaft to be converted to the rotation of the second main displacement member with a delay.

According to the twelfth aspect of the present invention, the use of the engagement between the holding part of the engagement groove and the guide pin allows the axial position of the second member connecting shaft to be held surely.

According to the thirteenth aspect of the present invention, the number of the guide rails can be increased without increasing the number of the actuators. Further, in the variable valve operating apparatus that includes the single actuator and one guide rail provided for each of both the cylinder groups, the operating characteristics of the valves for a plurality of cylinders can be switched collectively and smoothly, while reducing the contact loads between the respective guide rails and the respective engagement parts, using the deformable member having the flexible part.

According to the fourteenth aspect of the present invention, the axial position of the second member connecting shaft can be surely held using a simple configuration.

DESCRIPTION OF SYMBOLS

Figure 1:
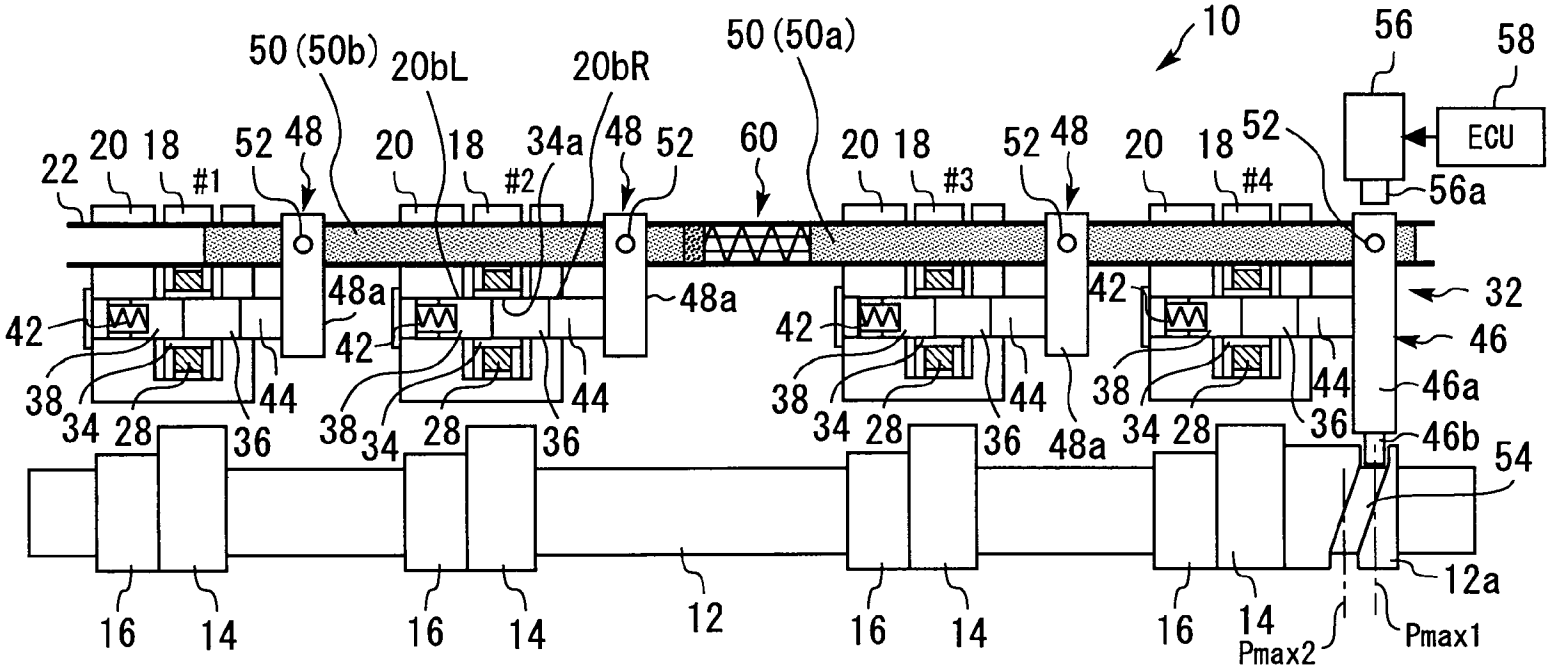
FIG. 1 is a schematic diagram showing the overall configuration of a variable valve operating apparatus for an internal combustion engine according to a first embodiment of the present invention.

10, 70, 81, 100, 120, 130, 140, 150 variable valve operating apparatus
12, 102, 122 camshaft
12*a*, 102*a*, 122*a* circular column part
14 main cam
16 auxiliary cam
18, 82 first rocker arm
20 second rocker arm
20*b*L, 20*b*R, 34*a* pin hole
22, 86, 138, 144, 160 rocker shaft
24 cam carrier
26 valve
28 cam roller
32 changeover mechanism
34 bush
36, 38, 44, 74, 76, 78, 79 changeover pin
42, 72 return spring
46 first link arm
46*a* arm part of first link arm
46*b* projection part of first link arm
46*c* pressing surface of first link arm
46*d* notch part of first link arm
48 second link arm
48*a* arm part of second link arm
50, 88, 106, 124, 154 link shaft
50*a*, 106*a*, 124*a*, 154*a* first link shaft
50*b*, 106*b*, 124*b*, 154*b* second link shaft
54 guide rail
54*a* proximal end
54*b* terminal end
54*c* shallow bottom part
56 electromagnetic solenoid
56*a* drive shaft
58 ECU (Electronic control Unit)
60, 80, 108, 126, 132, 142, 152 delay mechanism
62 in-delay-mechanism link shaft (third link shaft)
62*a* abutment part
64 delay mechanism spring
66 elongated hole of in-delay-mechanism link shaft
68 stroke-limiting pin
84 press-fit pin
86*a* elongated hole of rocker shaft

88*a* gate groove of link shaft
90 restricting mechanism
104, 148, 156 third link arm
104*a* arm part of third link arm
104*b* projection part of third link arm
106*a*1 concave part of first link shaft
106*a*2 latch part of first link shaft
106*b*1 circular column part of second link shaft
106*a*2 latch part of second link shaft
106*b*3 lock groove of second link shaft
110 torsion spring
112, 162 ball plunger
114, 164 spring
124*c* third link shaft
124*d* fourth link shaft
134 first fixing member
134*a* first tapered surface
136 second fixing member
136*a* second tapered surface
144*a* guide groove of rocker shaft
144*a*1 one end of guide groove of rocker shaft
144*a*2 the other end of guide groove of rocker shaft
146 guide pin
148*a* bearing part of third link arm
148*b* engagement groove of third link arm
148*b*1 first groove part of engagement groove of third link arm
148*b*2 second groove part of engagement groove of third link arm
154*b*1 through hole of second link shaft
156*e* through hole of third link arm
158 deformable member
158*a* flexible part of deformable member
158*b* rigid part of deformable member
158*b*1 lock groove of deformable member
160*a* relief hole of rocker shaft
Pmax1 displacement end
Pmax2 displacement end

DESCRIPTION OF EMBODIMENTS

First Embodiment

Hereinafter, a first embodiment of the present invention will be described with reference to FIG. 1 to 9.

[Configuration of Variable Valve Operating Apparatus]

(Basic Configuration of Variable Valve Operating Apparatus)

FIG. 1 is a schematic diagram showing the overall configuration of a variable valve operating apparatus 10 for an internal combustion engine according to the first embodiment of the present invention. To be more specific, FIG. 1 is a partial cross-sectional view represented by cutting a part of the variable valve operating apparatus (rocker arms 18 and 20 and a rocker shaft 22) in a plane including the axial line of the rocker shaft 22 and the axial line of the changeover pins 36, 38 and 44. Here, the internal combustion engine of the present embodiment is supposed to be a straight four-cylinder engine having four cylinders (#1 to #4) in which the combustion stroke take places in the order from #1 to #3, to #4, and to #2. Moreover, it is supposed that two intake valves and two exhaust valves are provided for each cylinder of the internal combustion engine. Thus, it is supposed that the configuration shown in FIG. 1 functions as a mechanism to drive two intake valves or two exhaust valves provided for each cylinder.

The variable valve operating apparatus 10 of the present embodiment includes a camshaft 12. The camshaft 12 is connected to a crankshaft, which is not shown, by means of a timing chain or a timing belt and is configured to rotate at a half speed of that of the crankshaft. The camshaft 12 is formed with one main cam 14 and one auxiliary cam 16 for one cylinder.

The main cam 14 includes an arc-shaped base-circle part 14*a* (see FIG. 4) concentric with the camshaft 12, and a nose part 14*b* (see FIG. 4) which is formed such that a part of the base-circle expands outwardly in the radial direction. Moreover, in the present embodiment, the auxiliary cam 16 is configured to be a cam which includes only a base-circle part (a zero lift cam). Moreover, as shown in FIG. 1, there are provided adjacently of each cylinder of the internal combustion engine, one first rocker arm 18 and one second rocker arm 20. The rocker arms 18 and 20 for each cylinder is rotatably (rockerably) supported by one rocker shaft 22. It is noted that the camshaft 12 and the rocker shaft 22 are supported by a cam carrier (or cylinder head) 24.

Figure 2:
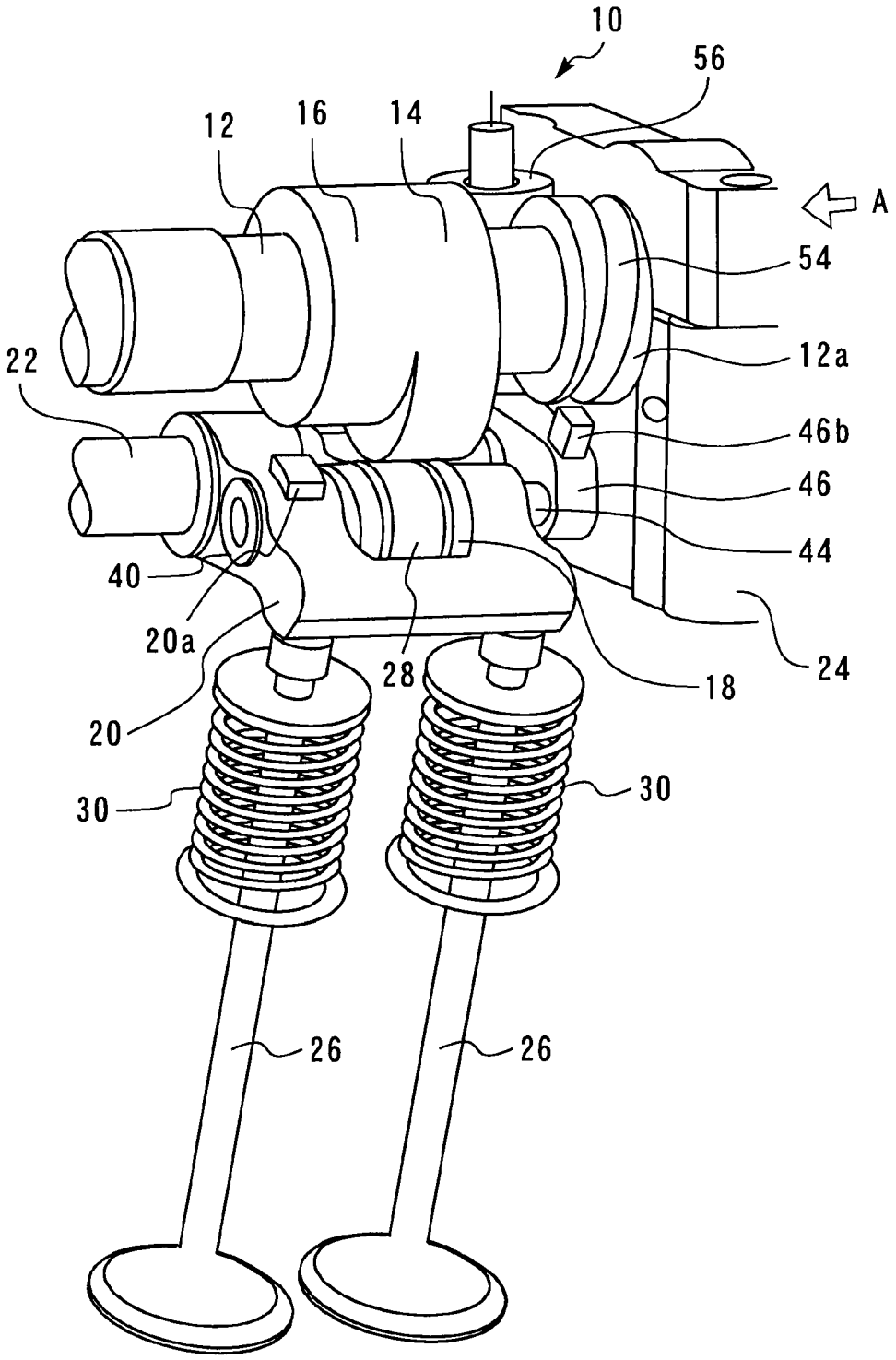
FIG. 2 is a perspective view illustrating the configuration around #4 cylinder in the variable valve operating apparatus shown in FIG. 1.
Figure 3:
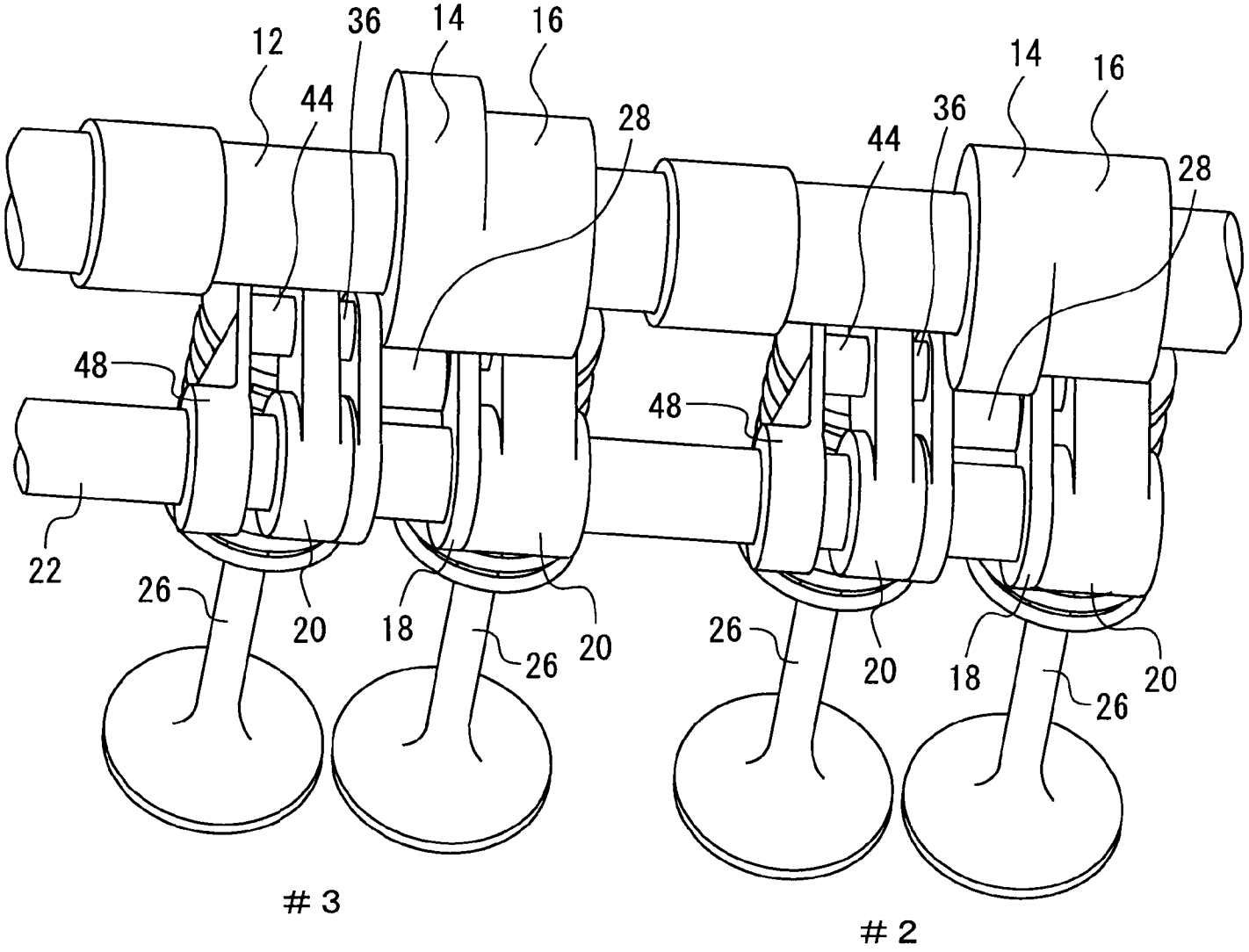
FIG. 3 is a perspective view illustrating the configuration around #2 and #3 cylinders in the variable valve operating apparatus shown in FIG. 1.

FIG. 2 is a perspective view illustrating the configuration around #4 cylinder in the variable valve operating apparatus 10 shown in FIG. 1. FIG. 3 is a perspective view illustrating the configuration around #2 and #3 cylinders in the variable valve operating apparatus 10 shown in FIG. 1. It is noted that the configuration of the variable valve operating apparatus 10 relating to #1 cylinder is the same as those of the variable valve operating apparatus 10 relating to #2 and #3. Moreover, the configuration of the variable valve operating apparatus 10 relating to #4 cylinder is basically the same as those of the variable valve operating apparatus 10 relating to #1 to #3 cylinders except for whether or not a guide rail 54 and an electromagnetic solenoid 56 described later are disposed, and except for whether a first link arm 46 is provided or a second link arm 48 is provided.

As shown in FIGS. 2 and 3, the rocker arms 18 and 20 are interposed between the cams 14, 16 and valves 26 as a transfer member that transfers the acting force of the main cam 14 to the valves 26. A cam roller 28 is rotatably attached to the first rocker arm 18 at a position which allows a contact with the main cam 14. The first rocker arm 18 is biased by a coil spring (not shown) attached to the rocker shaft 22 such that the cam roller 28 is constantly in abutment with the main cam 14. The first rocker arm 18 configured as described above oscillates with the rocker shaft 22 as a fulcrum through the cooperation between the acting force of the main cam 14 and the biasing force of the coil spring.

As shown in FIG. 1, the second rocker arm 20 for driving the two valves 26 is integrally configured so as to surround the first rocker arm 18. Moreover, the second rocker arm 20 is provided with a pad part 20*a* at a position which allows a contact with the auxiliary cam 16 in a base-circle section of the main cam 14. Furthermore, the valve 26 is biased in the valve-closing direction by a valve spring 30. The acting force of the main cam 14 is arranged to be transferred to the two valves 26 via the rocker arms 18 and 20. Because of this, the valve 26 can be opened and closed by use of the acting force of the cam 14 and the biasing force of valve spring 30.

(Configuration of Changeover Mechanism)

As shown in FIG. 1, the variable valve operating apparatus 10 includes a changeover mechanism 32 to switch between a connection state in which the first rocker arm 18 is connected with the second rocker arm 20 (see FIG. 6(A) described later), and a disconnection state in which this connection is released (see FIG. 6(B) described later). The variable valve operating apparatus 10 that includes such changeover mechanism 32 makes it possible to switch the operating characteristics of the valves 26 between a valve operating state and a valve stop state by switching the state in which the acting force of the main cam 14 is transferred to the second rocker arm 20 via the first rocker arm 18 (the above described connection state) and the state in which the forgoing acting force is not transferred to the second rocker arm 20 (the above described disconnection state).

Hereinafter, the configuration of the changeover mechanism 32 will be described in detail arbitrarily with newly reference to FIGS. 4 to 6 in addition to above FIGS. 1 to 3.

Figure 4:
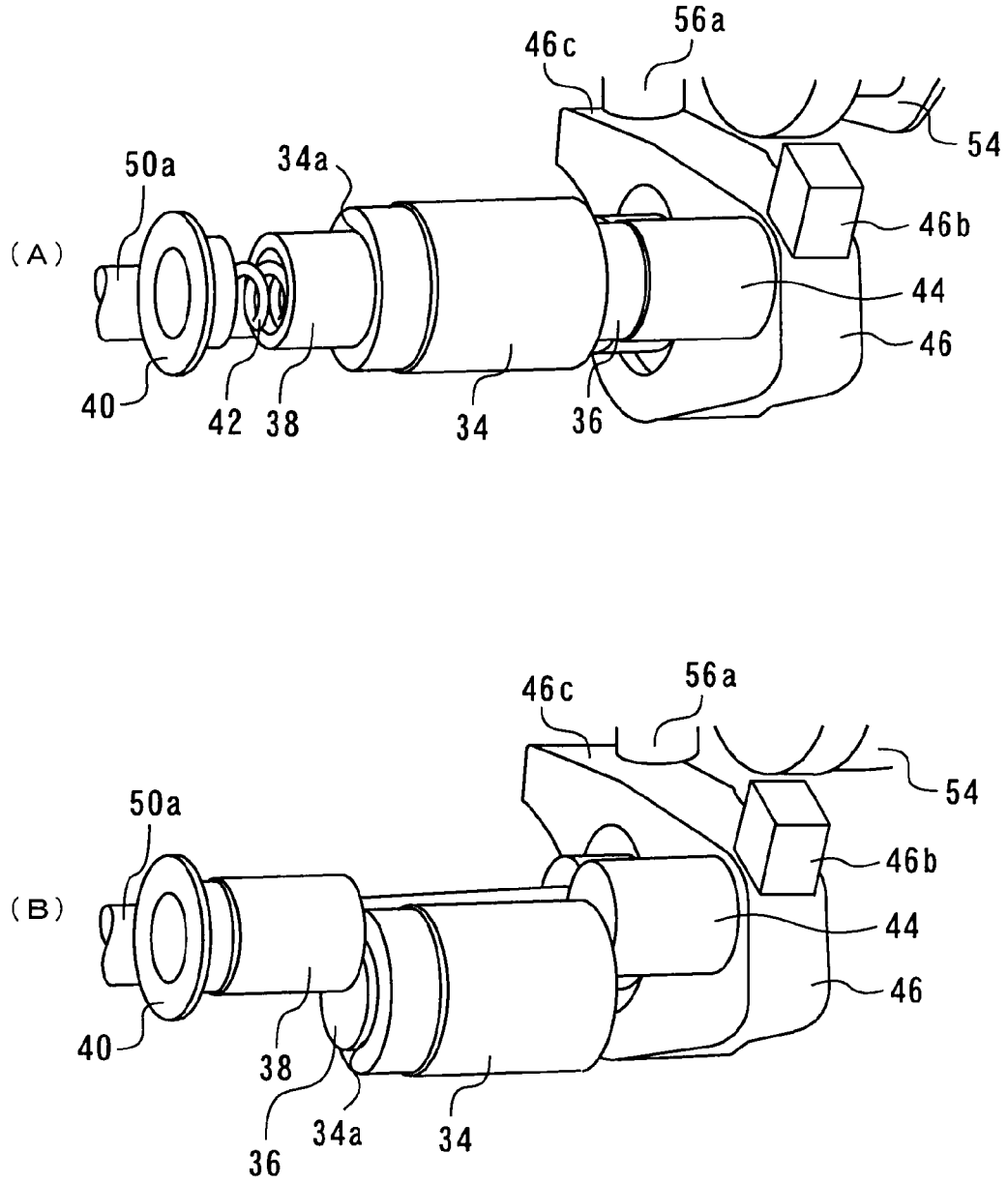
FIG. 4 is a perspective view in which the camshaft and the rocker arms are hidden in the configuration shown in FIG. 2.

FIG. 4 is a perspective view in which the camshaft 12 and the rocker arms 18 and 20 are hidden in the configuration shown in FIG. 2. To be more specific, FIG. 4(A) shows the above described connection state, in which the main cam 14 does not press the cam roller 28, and FIG. 4(B) shows the above described disconnection state, in which the main cam 14 presses the cam roller 28.

As shown in FIG. 1, a first pin hole 34*a* concentric with the cam roller 28 is formed inside a bush 34 that functions as a spindle of the cam roller 28, and two second pin holes 20*b*L, 20*b*R are formed inside the second rocker arm 20 at a position corresponding to the first pin hole 34*a*. The centers of these pin holes 34*a*, 20*b*L and 20*b*R are aligned on the same circular arc about the rocker shaft 22 which is the rotation center of the rocker arms 18 and 20. Further, when the cam roller 28 is in abutment with the base-circle part 14*a* of the main cam 14 and the pad part 20*a* is in abutment with the base-circle part of the auxiliary cam 16, the position of the first pin hole 34*a* is arranged to be aligned with the positions of the second pin holes 20*b*L and 20*b*R.

Furthermore, a changeover pin 36 of a circular column shape is movably inserted into the first pin hole 34*a*. Moreover, a changeover pin 38 of a circular column shape which is in abutment with the changeover pin 36 is movably inserted into one (left side in FIG. 1) of the second pin holes, 20*b*L. The end part opposite to the first rocker arm 18 in the second pin hole 20*b*L into which the changeover pin 38 is inserted is closed by a cap 40. Moreover, inside the second pin hole 20*b*L, there is disposed a return spring 42 which biases the changeover pin 38 toward the first rocker arm 18 direction (hereafter, referred to as the "advancing direction of changeover pin"). To be more specific, the return spring 42 is set in such a way as to, in a mounted state, constantly bias the changeover pin 38 toward the first rocker arm 18 side.

In addition, a changeover pin 44 of a circular column shape which is in abutment with the changeover pin 36 is movably inserted into the other (right side in FIG. 1) of the second pin holes, 20*b*R. Further, as for #4 cylinder, there is disposed at one side of the second rocker arm 20, a first link arm 46 having an arm part 46*a* which is in abutment with the changeover pin 44. The first link arm 46 is supported by the rocker shaft 22. On the other hand, as for #1 to #3 cylinders, there is disposed at the other side of the second rocker arm 20, a second link arm 48 having an arm part 48*a* which is in abutment with the changeover pin 44. The second link arm 48 is supported by the rocker shaft 22.

The difference points of the first link arm 46 with respect to the second link arm 48 are as follows. That is to say, at the distal end part 46*a* of the first link arm 46, a projection part 46*b* is provided at a position where the same can protrude toward the peripheral surface of the camshaft 12. Moreover, as shown in FIG. 4, a pressing surface 46*c* pressed by an electromagnetic solenoid 56 described later is provided at the end part opposite to the arm part 46*a* in the first link arm 46.

Figure 5:
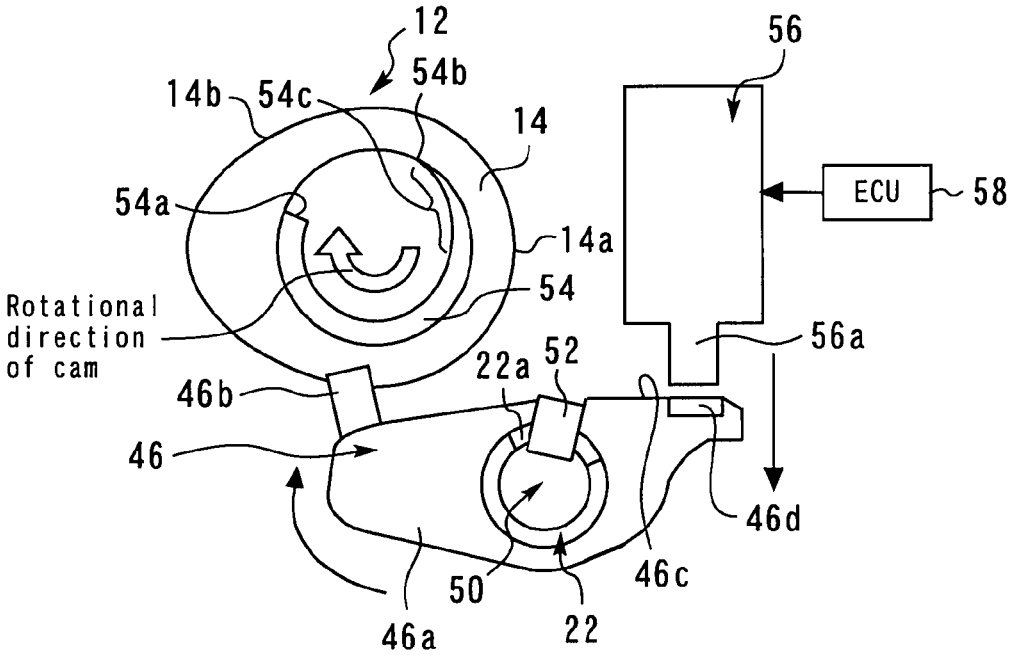
FIG. 5 is a view of the variable valve operating apparatus shown in FIG. 1, as viewed from the axial direction of the camshaft (and rocker shaft) (more specifically, the direction shown by an arrow A in FIG. 2)

FIG. 5 is a view of the variable valve operating apparatus 10 shown in FIG. 1, as viewed from the axial direction of the camshaft 12 (and rocker shaft 22) (more specifically, the direction shown by an arrow A in FIG. 2).

As shown in FIGS. 1 and 5, the rocker shaft 22 is formed into a hollow shape. A link shaft 50 is inserted into the rocker shaft 22. The link shaft 50 is equipped so as to allow the first link arm 46 provided for #4 cylinder and the second link arms 48 provided for #1 to #3 cylinders to be displaced while simultaneously operating in the axial direction of the rocker shaft 22. To be more specific, the link shaft 50 is separated into a first link shaft 50*a* to which the first link arm 46 provided for #4 cylinder and the second link arm 48 provided for #3 cylinder are attached, and a second link shaft 50*b* to which the second link arm 48 provided for #2 cylinder and the second link arm 48 provided for #1 cylinder. Further, the first link shaft 50*a* is interlinked with the second link shaft 50*b* via a delay mechanism 60 described later with reference to FIG. 7.

Moreover, as shown in FIGS. 1 and 5, the link shaft 50 and the rocker shaft 22 inserted thereinto extend through the inside of the link arms 46 and 48. Further, the link arms 46 and 48 for each cylinder are fixed to the first link shaft 50*a* or the second link shaft 50*b* by use of a press-fit pin 52. It is noted that a through hole 22*a* is formed in a size which, when the first link arm 46 is rotated as a result of the actuation of the electromagnetic solenoid 56 described later, is enough such that the rotation of the first link arm 46 is not inhibited due to the collision with the press-fit pin 52. Furthermore, the through hole 22*a* is formed into an elongate hole shape such that when the link shafts 50*a* and 50*b* are moved in the axial direction thereof as a result of the actuation of the electromagnetic solenoid 56, the movements of the link shafts 50*a* and 50*b* are not inhibited due to the collision with the press-fit pin 52.

Moreover, as shown in FIGS. 1, 2 and 5, a circular column part 12*a* formed into a circular column shape is formed at the portion opposite to the projection part 46*b* provided at the first link arm 46 in the camshaft 12. There is formed in the outer peripheral surface of the circular column part 12*a*, a helical-shaped guide rail 54 extending in the circumferential direction. Here, the guide rail 54 is shaped as a helical groove.

Moreover, the changeover mechanism 32 includes the electromagnetic solenoid 56 as an actuator that produces a driving force to engage the projection part 46*b* with the guide rail 54 (insert the projection part 46*b* into the guide rail 54). The electromagnetic solenoid 56 is arranged to be duty controlled on the basis of a command from an ECU (Electronic Control Unit) 58. The ECU 58 is an electronic control unit for controlling the operational state of the internal combustion engine. It is supposed that the electromagnetic solenoid 56 is fixed to a cam carrier (or a cylinder head), at a position where a drive shaft 56*a* thereof can press the pressing surface 46*c* of the first link arm 46 toward the guide rail 54.

Moreover, the helical direction in the guide rail 54 is arranged such that when the camshaft 12 is rotated in a predetermined rotational direction shown in FIG. 5 with the projection part 46*b* being inserted thereinto, the first link arm 46, the link shaft 50 in conjunction with the first link arm 46, and the second link arm 48 driven by the link shaft 50 are allowed to be displaced in the left direction in FIG. 1. To be more specific, the left direction in FIG. 1 is a direction in which the first link arm 46 and the second link arm 48 approaches the rocker arms 18 and 20 while each of the first link arm 46 and the second link arm 48 are pushing aside the changeover pins 36, 38 and 44 in the retreating direction thereof (the opposite direction to the advancing direction of the above-described changeover pin) with resisting the biasing force of the return spring 42.

Figure 6:
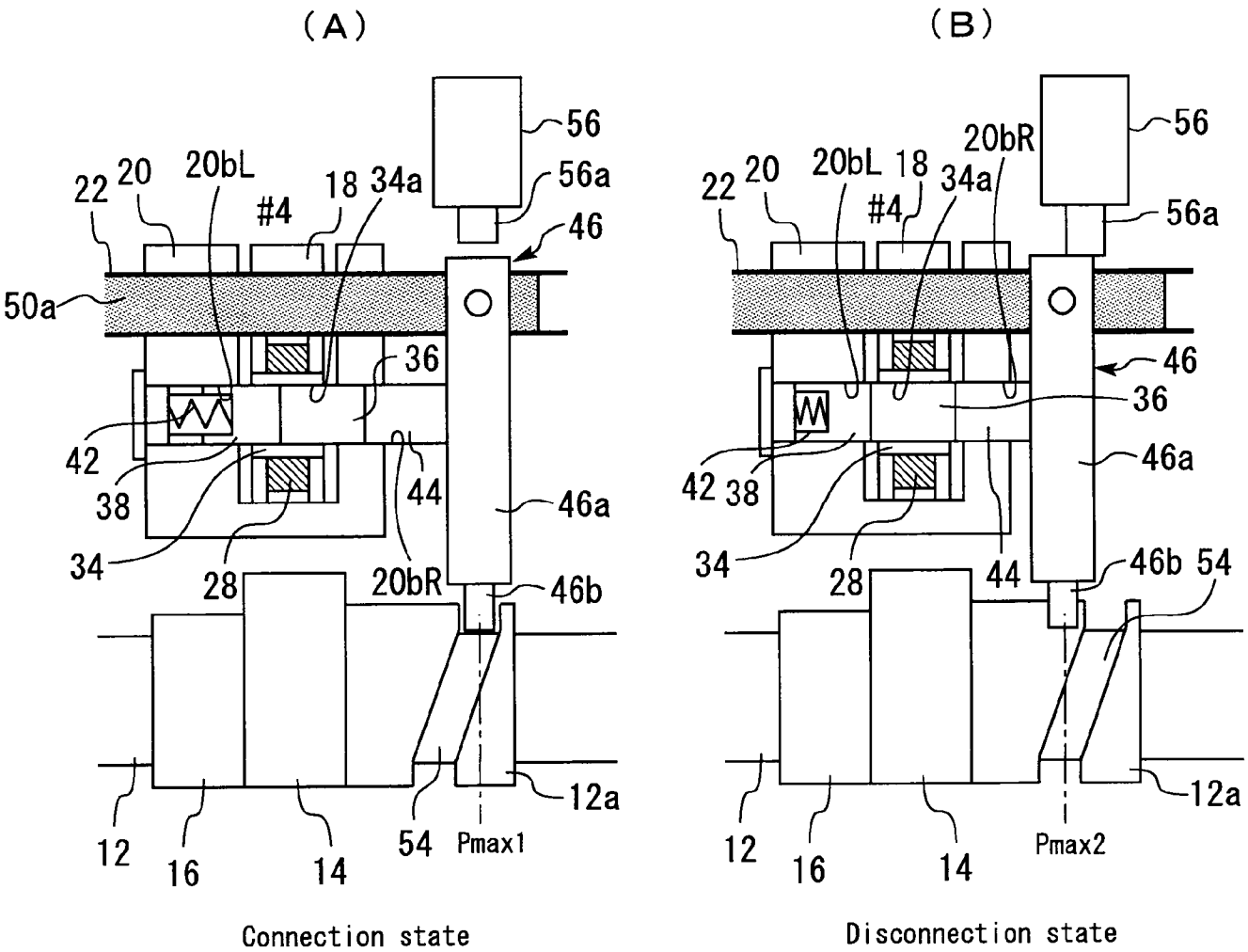
FIG. 6 is a partial cross-sectional view illustrating the configuration of a section around #4 cylinder of the variable valve operating apparatus.

FIG. 6 is a partial cross-sectional view illustrating the configuration of a section around #4 cylinder of the variable valve operating apparatus 10. To be more specific, FIG. 6(A) shows the variable valve operating apparatus 10 in the connection state, and FIG. 6(B) shows the variable valve operating apparatus 10 in the disconnection state.

The position of the first link arm 46 in FIG. 6(A), that is, the position of the first link arm 46 in a state where the changeover pin 36 is inserted into both the pin holes 34*a* and 20*b*R by the biasing force of the return spring 42 and where the changeover pin 38 is inserted into both the pin holes 34*a* and 20*b*L, is referred to as a "displacement end Pmax1". When the first link arm 46 is positioned at this displacement end Pmax1, the first rocker arm 18 and the second rocker arm 20 come into the above-described connection state. Moreover, the position of the first link arm 46 in FIG. 6(B), that is, the position of the first link arm 46 in a state where as a result of the changeover pins 36, 38 and 44 being subjected to a force by use of the rotational force of the camshaft 12 from the link arms 46 and 48, the changeover pins 36, 38 and 44 are respectively inserted only into the first pin hole 34*a*, the second pin hole 20*b*L and the second pin hole 20*b*R, is referred to as a "displacement end Pmax 2". That is, when the first link arm 46 is positioned at this displacement end Pmax2, the first rocker arm 18, and the second rocker arm 20 come into the above-described disconnection state.

In the present embodiment, the position of a proximal end 54*a* of the guide rail 54 in the axial direction of the camshaft 12 is arranged so as to coincide with the position of the projection part 46*b* when the first link arm 46 is positioned at the above-described displacement end Pmax1. Further, the position of a terminal end 54*b* of the guide rail 54 in the axial direction of the camshaft 12 is arranged so as to coincide with the position of the projection part 46*b* when the first link arm 46 is positioned at the above-described displacement end Pmax2. That is, in the present embodiment, the configuration is made such that the first link arm 46 is displaceable between the displacement end Pmax1 and the displacement end Pmax2 within the range in which the projection part 46*b* is guided by the guide rail 54.

Further, as shown in FIG. 5, the guide rail 54 is provided with a shallow bottom part 54*c*, in which the depth of the guide rail 54 gradually decreases as the camshaft 12 rotates, as a predetermined section of the terminal end 54*b* side after the first link arm 46 reaches the displacement end Pmax2. Moreover, the first link arm 46 is provided with a notch part 46*d* which is formed into a concave shape by notching a part of the pressing surface 46*c*. The pressing surface 46*c* is provided so as to be kept in abutment with the drive shaft 56*a* while the first link arm 46 is displaced from the displacement end Pmax1 to the displacement end Pmax2. Further, the notch part 46*d* is provided in a portion where it can be engaged with the drive shaft 56*a* when the projection part 46*b* is taken out on the surface of the circular column part 12*a* by the action of the above-described shallow groove part 54*c*, in a state where the first link arm 46 is positioned at the above-described displacement end Pmax2. Furthermore, the above-described notch part 46*d* is formed so as to be engaged with the drive shaft 56*a* in a mode in which the rotation of the first link arm 46 in the direction in which the projection part 46*b* is inserted into the guide rail 54 can be restricted, and the movement of the first link arm 46 toward the displacement end Pmax1 can be restricted.

As described so far, the changeover mechanism 32 is configured by the changeover pins 36, 38 and 44, the return spring 42, the first link arm 46, the second link arm 48, the link shaft 50 (50*a*, 50*b*), the press-fit pin 52, the guide rail 54, and the electromagnetic solenoid 56 the energization of which is controlled by the ECU 58.

(Configuration of Delay Mechanism)

Figure 7:
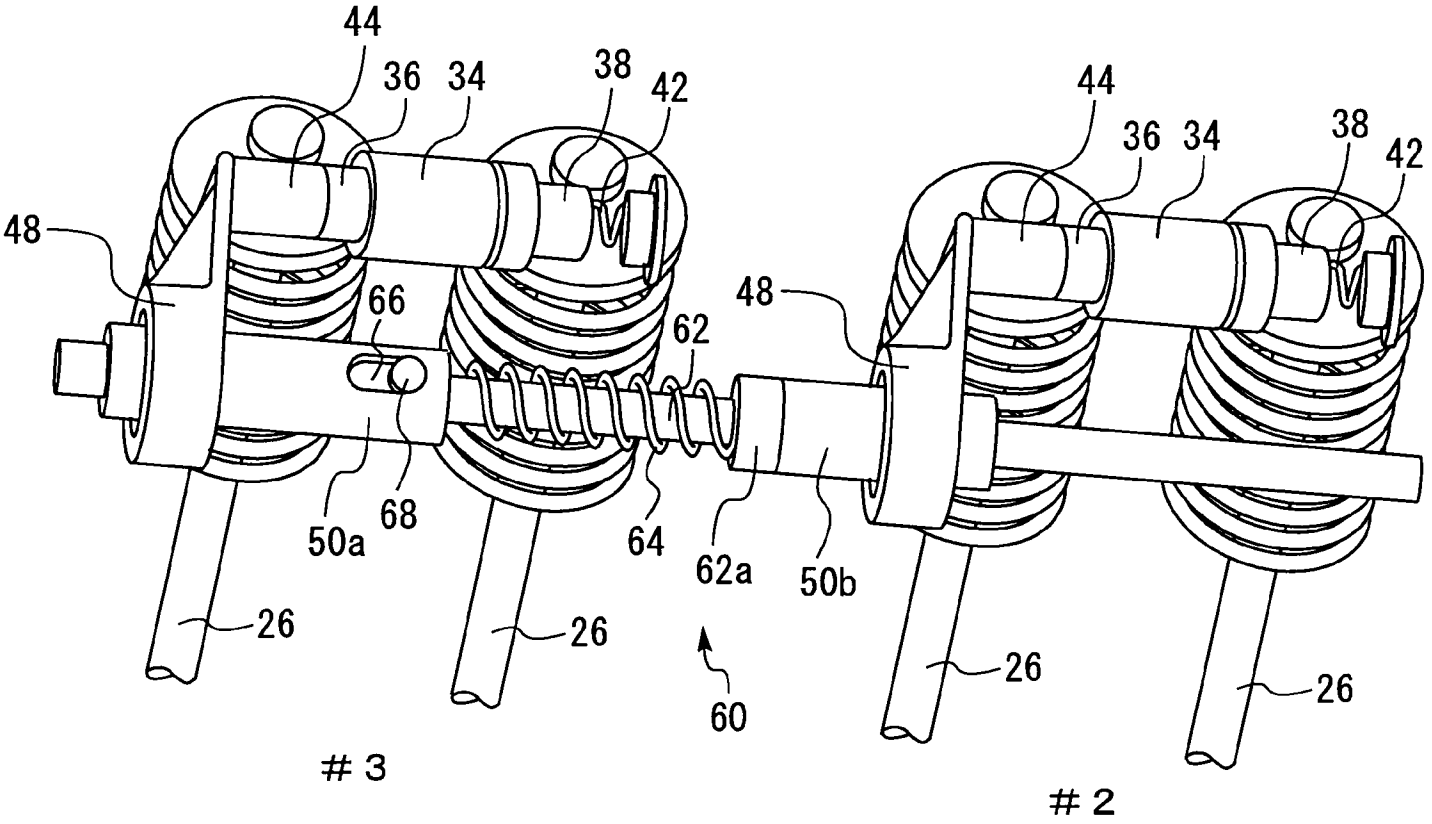
FIG. 7 is a perspective view for illustrating a detailed configuration of the delay mechanism shown in FIG. 1.

FIG. 7 is a perspective view for illustrating a detailed configuration of the delay mechanism 60 shown in FIG. 1. It is noted that FIG. 7 is a perspective view in which the camshaft 12 and the rocker arms 18 and 20 in the configuration shown in FIG. 4 are hidden.

As shown in FIGS. 1 and 7, the delay mechanism 60 is interposed at some point in the link shaft 50 between #2 cylinder and #3 cylinder. In other words, in the internal combustion engine of the present embodiment which includes a first cylinder group made up of a plurality of cylinders lying side by side (#3 and #4 cylinders) and a second cylinder group made up of another plurality of cylinders lying side by side (#1 and #2 cylinders), and has an explosion sequence which is set in such a way that a common base-circle section of the main cam 14 is present with respect to the #3 and #4 cylinders belonging to the first cylinder group and another common base-circle section of the main cam 14 is present with respect to #1 and #2 cylinders belonging to the second cylinder group, the delay mechanism 60 is interposed at some point in the link shaft 50 between the first cylinder group and the second cylinder group.

The delay mechanism 60 is disposed in the rocker shaft 22. To be more specific, the delay mechanism 60 is provided with an in-delay-mechanism link shaft 62 which provides one end with an abutment part 62*a* that is in abutment with the second link shaft 50*b* (hereinafter, referred to as a "third link shaft"). The abutment part 62*a* is formed having a diameter larger than other parts. Moreover, a part of the other end side of the third link shaft 62 is inserted into the first link shaft 50*a* that is formed into a hollow shape.

Moreover, the delay mechanism 60 includes a delay mechanism spring 64 whose length is defined between the abutment part 62*a* of the third link shaft 62 and the end part of the delay mechanism 60 side in the first link shaft 50*a*. Further, in the first link shaft 50*a*, an elongated hole 66 is formed in a region into which the third link shaft 62 is inserted. A stroke-limiting pin 68 that is press-fitted into the third link shaft 62 is engaged with the elongated hole 66, and the third link shaft 62 is configured so as to be movable in its axial direction within the range in which the stroke-limiting pin 68 is restricted by the elongated hole 66. By limiting the stroke of the third link shaft 62 using such stroke-limiting pin 68 and elongated hole 66, when the driving force of the first link shaft 50*a* is not transferred via the first link arm 46, it is possible to hold the delay mechanism 60 in a state in which the spring load of the delay mechanism spring 64 is set to an appropriate initial set load shown below.

In the present embodiment, in order to be able to smoothly operate the delay mechanism 60 when collectively switching the rocker arms 18 and 20 for all cylinders from the connection state to the disconnection state, the spring load of the delay mechanism spring 64 is set so as to be greater than the total value of the spring loads of the return springs 42 provided for #1 and #2 cylinders, and be smaller than a frictional force (a sliding resistance) existing between the changeover pins 36, 38, and the pin holes 34*a*, 20*b*L and 20*b*R when the rocker arms 18 and 20 are oscillated (when the valves 26 are lifted).

[Operation of the Variable Valve Operating Apparatus]

Next, the operation of the variable valve operating apparatus 10 (the switching operation of the operating characteristics of the valves 26 between the valve operating state and the valve stop state, and the operation of the delay mechanism 60) of the present embodiment will be described with newly and mainly reference to FIGS. 8 and 9 in addition to FIG. 6.

Figure 8:
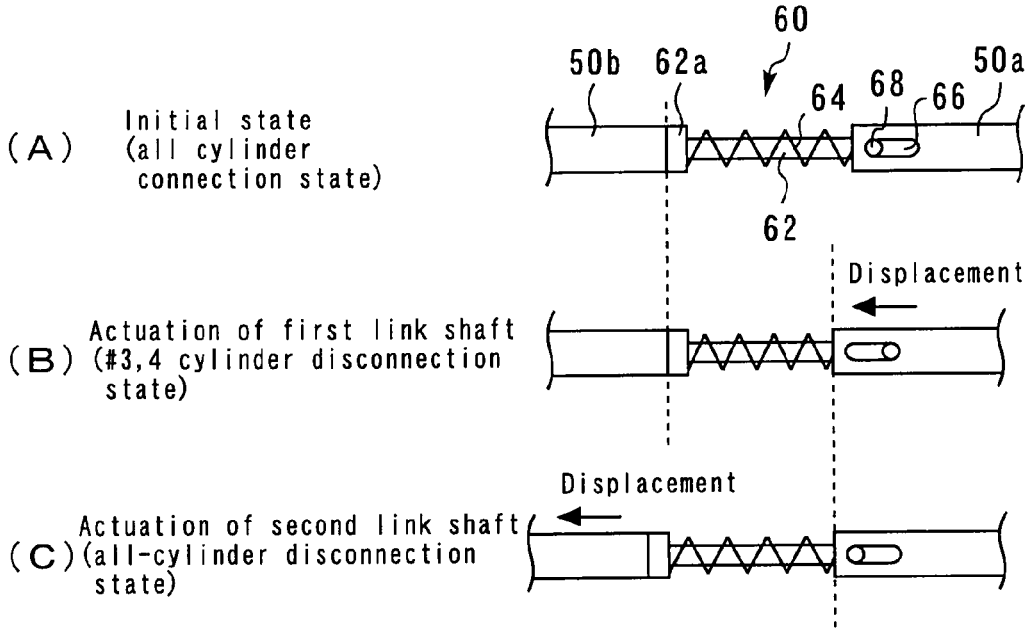
FIG. 8 is diagram for explaining the operation of the delay mechanism in association with the displacement of a first link arm using a guide rail and an electromagnetic solenoid 56.
Figure 9:
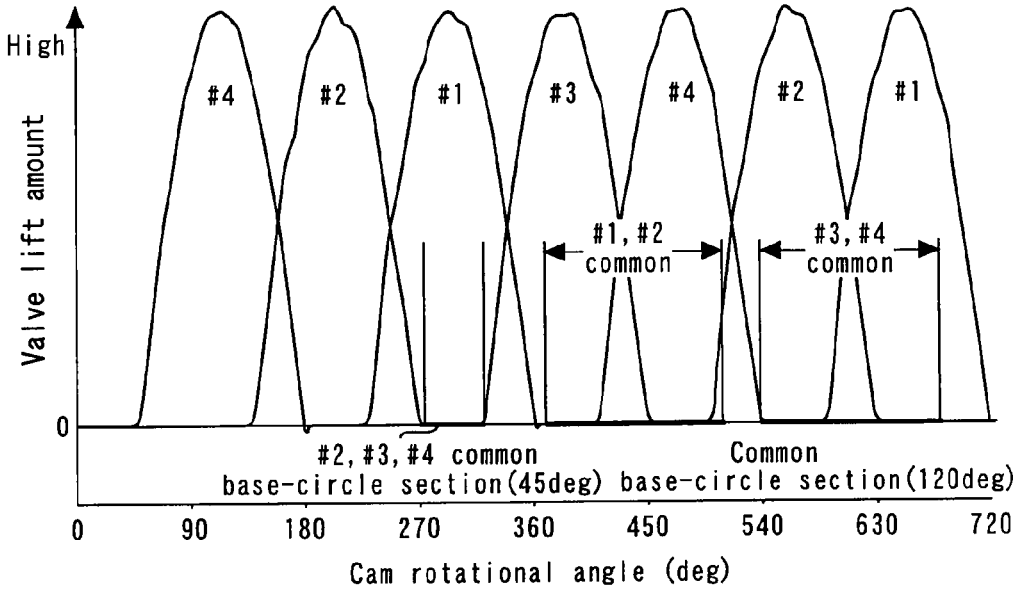
FIG. 9 is a diagram collectively showing lift curves of the valves for each cylinder.

FIG. 8 is diagram for explaining the operation of the delay mechanism 60 in association with the displacement of the first link arm 46 using the guide rail 54 and the electromagnetic solenoid 56. FIG. 9 is a diagram collectively showing lift curves of the valves 26 for each cylinder, and the horizontal axis thereof is the rotational angle (cam angle) of the main cam 14.

(At the Time of Valve Operating State)

First of all, the driving of the electromagnetic solenoid 56 is turned OFF at the time of the valve operating state, and thus the first link arm 46 is positioned at the displacement end Pmax1 being separated from the camshaft 12 and subjected to the biasing force of the return spring 42. In this state, as shown in FIG. 6(A), the first rocker arm 18 and the second rocker arm 20 are connected via the changeover pins 36 and 38 (the above-described connection state). As a result of that, the acting force of the main cam 14 is transferred from the first rocker arm 18 to both the valves 26 via the second rocker arm 20. Thus, the normal lift operation of the valve 26 is performed according to the profile of the main cam 14.

(At the Time of Valve Stop Control)

The valve stop operation is performed when, for example, a predetermined execution request of the valve stop operation such as a fuel cut request of the internal combustion engine is detected by the ECU 58. As is known from the lift curves of the valves for each cylinder shown in FIG. 9, there is a common base-circle section of the main cam 14 (section where the valve 26 is not lifted) relating to #3 and #4 cylinders in the internal combustion engine of the present embodiment in which the explosion order is #1 to #3, to #4, and to #2. If the request of the valve stop operation is issued, the energization of the electromagnetic solenoid 56 is started at a timing at which the above-described common base-circle section arrives. As a result of this, the first link arm 46 is rotated about the rocker shaft 22 in the clockwise fashion shown in FIG. 5. When the first link arm 46 is rotated like this, the projection part 46*b* is engaged with the guide rail 54. As a result of that, the first link arm 46 comes to be moved toward the displacement end Pmax2 with the aid of the rotational force of the camshaft 12 as a result of the projection part 46*b* being guided by the guide rail 54. Then, the driving force of the first link arm 46 from the guide rail 54 is transferred to the second link arm 48 for #3 cylinder via the press-fit pin 52 and the first link shaft 50*a*, and thereby the first link shaft 50*a* coupled to the first link arm 46 and the second link arm 48 for #3 cylinder coupled to the first link shaft 50*a* come to be displaced in synchronization with the first link arm 46.

The operation after the first link arm 46 reaches the displacement end Pmax 2 differs between #3 and #4 cylinders, and #1 and #2 cylinders. First, relating to #3 and #4 cylinders, the first rocker arm 18 and the second rocker arm 20 are promptly put in the disconnection state because as a result of the displacement of the first link shaft 50*a*, the changeover pins 36 and 38 are returned into the pin holes 34*a* and 20*b*L, respectively. As a result of that, the acting force of the main cam 14 comes not to be transferred to the second rocker arm 20 via the first rocker arm 18. Moreover, the auxiliary cam 16, against which the second rocker arm 20 abuts, is a zero lift cam. Therefore the force for driving the valve 26 is no more provided to the second rocker arm 20, to which the acting force of the main cam 14 has come not to be transferred. As a result of that, since, regardless of the rotation of the main cam 14, the second rocker arm 20 comes into a stationary state, the lift operation of the valve 26 becomes stopped at the valve closing position.

As described above, displacing the first link arm 46 within the common base-circle section relating to #3 and #4 cylinders makes the first link shaft 50*a* for #3 and #4 cylinders displaceable. On the other hand, in the above-described common base-circle section, the first rocker arm 18 for at least one of #1 and #2 cylinders is oscillated by the main cam 14. Because of this, in the cylinder(s) during the oscillation operation of the first rocker arm 18, out of #1 and #2 cylinders, the changeover pins 36 and 38 are subjected to a shearing force by both of the first rocker arm 18 driven by the main cam 14, and the second rocker arm 20 subjected to the biasing force from the valve spring 20. As a result, the frictional force (sliding resistance) existing between the changeover pins 36 and 38, and the pin holes 34*a*, 20*b*L and 20*b*R becomes greater than that during a non-oscillation operation of the first rocker arm 18. As already described, the spring load of the delay mechanism spring 64 is set so as to become smaller than the frictional force (sliding resistance) existing when the rocker arms 18 and 20 oscillate (when the valves 26 is lifted) between the changeover pins 36 and 38, and the pin holes 34*a*, 20*b*L and 20*b*R. Thus, when the first link shaft 50*a* is displaced in synchronization with the displacement of the first link arm 46 as described above, the operational state of the delay mechanism 60 moves from the initial state shown in FIG. 8(A) to the state shown in FIG. 8(B), and thereby the second link shaft 50*b* comes into a state in which the delay mechanism spring 64 is compressed without yet being displaced in synchronization with the displacement of the first link shaft 50*a*.

If the oscillation operation of the first rocker arm 18 (the lift operation of the valves 26) for #1 cylinder is completed when the delay mechanism 60 is put in the state shown in FIG. 8(B), the common base-circle section of the main cam 14 relating to #1 and #2 cylinders arrives. In the state in which this common base-circle section has arrived, the friction force existing between the changeover pins 36 and 38, and the pin holes 34*a*, 20*b*L and 20*b*R in #1 and #2 cylinders becomes small. Moreover, as already described, the spring load of the delay mechanism spring 64 is set so as to be greater than the total value of the spring loads of the return springs 42 provided for #1 and #2 cylinders. Thus, the operational state of the delay mechanism 60 moves from the state shown in FIG. 8(B) to the state shown in FIG. 8(C), and thereby the displacement of the second link shaft 50*b* for #1 and #2 cylinders is performed after being delayed by the delay mechanism 60. As a result of that, the first rocker arm 18 and the second rocker arm 20 promptly comes into the disconnection state because as a result of the displacement of the second link arms 48 for #1 and #2 cylinders accompanied with the displacement of the second link shaft 50*b*, the changeover pins 36 and 38 are returned into the pin holes 34*a* and 20*b*L, respectively. Consequently, also relating to #1 and #2 cylinders, since, regardless of the rotation of the main cam 14, the second rocker arm 20 comes into a stationary state, the lift operation of the valves 26 becomes stopped at the valve closing position.

(Operation for Holding the Valve Stop State)

Moreover, when the first link arm 46 reaches the displacement end Pmax2, the action of the shallow bottom part 54*c* of the guide rail 54 causes the first link arm 46 to rotate in the direction separated from the camshaft 12 (guide rail 54). Then, when the first link arm 46 further rotates until the drive shaft 56*a* which is constantly driven by the electromagnetic solenoid 56 coincides with the notch part 46*d*, the portion of the first link arm 46 side, which is to be abutment with the drive shaft 56*a*, is switched from the pressing surface 46*c* to the notch part 46*d*. As a result of that, the drive shaft 56*a* comes to be engaged with the notch part 46*d*, and thereby the first link arm 46 comes to be held with the projection part 46*b* being separated from the camshaft 12, and with the biasing force of the return spring 42 being received by the drive shaft 56*a*. For this reason, the state in which the first rocker arm 18 and the second rocker arm 20 are disconnected, that is, the valve stop state is maintained.

(At the Time of the Valve Return Operation)

A valve return operation for returning the operation from the valve stop state to the valve operating state is performed, for example, when a predetermined execution request of the valve return operation such as a request for returning from a fuel cut is detected by the ECU 58. Such valve return operation is started by the ECU 58 turning OFF the energization to the electromagnetic solenoid 56 at a predetermined timing. When the energization to the electromagnetic solenoid 56 is turned OFF, the engagement between the notch part 46*d* of the first link arm 46 and the drive shaft 56*a* is released. As a result of that, the force to hold the changeover pins 36 and 38 in the pin holes 34*a* and 20*b*L against the biasing force of the return spring 42 disappears. Because of this, the changeover pins 36 and 38 move in the advancing direction by the biasing force of the return spring 42, thereby returning into a state in which the first rocker arm 18 and the second rocker arm 20 are connected via the changeover pins 36 and 38, that is, a state in which the lift operation of the valves 26 is enabled by the acting force of the main cam 14. Moreover, as the changeover pins 36 and 38 moves in the advancing direction by the biasing force of the return spring 42, the first link arm 26 (and the link shaft 50 and second link arms 48 in synchronization therewith) is returned from the displacement end Pmax2 to the displacement end Pmax1 via the changeover pin 44.

Advantages of the Variable Valve Operating Apparatus of the First Embodiment

According to the variable valve operating apparatus 10 of the present embodiment thus configured, it becomes possible to switch the operational states of the valves 26 between the valve operating state and the valve stop state in #4 cylinder for which the first link arm 46 is provided, by moving the axial position of the first link arm 46 between the displacement end Pmax1 and the displacement end Pmax2, with the aid of the ON and OFF of the energization of the electromagnetic solenoid 56, the rotational force of the camshaft 12, and the biasing force of the return spring 42; and moreover, also in #3 cylinder, it becomes possible to switch the operational states of the valves 26 between the valve operating state and the valve stop state via the first link shaft 50*a* and the second link arm 48 in synchronization with the first link arm 46. Furthermore, the variable valve operating apparatus 10 includes the delay mechanism 60 which delays the displacement of the second link shaft 50*b* until the common base-circle section relating to #1 and #2 cylinders arrives. Therefore, also relating to #1 and #2 cylinders in which the valves 26 in at least one of them are being lifted at the time of operating the electromagnetic solenoid 56, it becomes possible to switch the operational states of the valves 26 between the valve operating state and the valve stop state accompanied by the delay with respect to #3 and #4 cylinders when their common base-circle section arrives.

In a straight four-cylinder engine that does not include the common base-circle section of the main cam 14 among all cylinders, if an attempt is made to collectively switch, without including the above-described delay mechanism 60, the operational states of the valves 26 in all cylinders by the utilization of the transmission of a force by the rigid member such as the link shaft 50, it is required to switch the operational states of the valves 26 also in the cylinder(s) in which the valves 26 are being lifted. Because of this, in that cylinder(s), the operating characteristics of the valves 26 are caused to be switched during the valve lift. Moreover, as described above, since the friction force existing between the changeover pins 36 and 38, and the pin holes 34*a* and 20*b*L and 20*b*R becomes large in the cylinder(s) during the valve lift, the driving force required for switching the operational states of the valves 26 of the cylinder(s) increases, and thereby a contact load between the guide rail 54 and the projection part 46*b* increases in the case of the present variable valve operating apparatus 10. In this way, if the attempt is made to collectively switch, without including the above-described delay mechanism 60, the operational states of the valves 26 in all cylinders by the utilization of the rigid member, it becomes hard to smoothly switch the operating characteristics of the valves 26 of each cylinder. Contrary to this, according to the variable valve operating apparatus 10 equipped with the delay mechanism 60 in the present embodiment, in the straight four-cylinder engine that does not include the common base-circle section of the main cam 14 among all cylinders, it becomes possible to collectively and smoothly switch, based on the operation of a single electromagnetic solenoid 56, the operational states of the valves 26 provided for all cylinders by the utilization of the link shaft 50 or the like which corresponds to the rigid member.

Moreover, as already described, the delay mechanism 60 of the present embodiment is interposed at some point in the link shaft 50 between #2 cylinder and #3 cylinder. In the internal combustion engine of the present embodiment, as described above, there are common base-circle sections of the main cam 14 relating to two cylinders (#3 and #4 cylinders, or #1 and #2 cylinders), and, as shown in FIG. 9, there are common base-circle sections of the cam 14 relating to three cylinders (for example, #2, #3 and #4 cylinders), Therefore, the configuration of the variable valve operating apparatus 10 shown in FIG. 1 may include a delay mechanism similar to the delay mechanism 60 between #1 cylinder and #2 cylinder, or between #3 cylinder and #4 cylinder. However, the common base-circle sections of the main cam 14 relating to the above-mentioned three cylinders is about 45 degrees in cam angle in the example shown in FIG. 9, while the common base-circle sections of the main cam 14 relating to the above-mentioned two cylinders are about 120 degrees in cam angle. If such common base-circle section of the main cam 14 is short, it is required to displace the first link arm 46 in a short time. As a result of that, it becomes required to form a helical groove of the guide rail 54 at an acute angle, and thus, since the contact load between the guide rail 54 and the projection part 46*b* increases, there is a concern of wear between both. Therefore, by providing the delay mechanism 60 between #2 cylinder and #3 cylinder as in the present embodiment, it becomes possible to ensure the common base-circle section of the main cam 14 long, thereby preventing the contact load between the guide rail 54 and the projection part 46*b* from increasing.

Moreover, as already described, the delay mechanism 60 of the present embodiment is installed in the rocker shaft 22. According to such configuration, the delay mechanism 60 can be installed without requiring a new room.

It is noted that in the first embodiment, which has been described above, the main cam 14 corresponds to the "cam" according to the above-described first aspect of the present invention; the first rocker arm 18 and the second rocker arm 20 to the "transfer member" according to the above-described first aspect of the present invention; the electromagnetic solenoid 56 to the "actuator" according to the above-described first aspect of the present invention; and the changeover pins 36, 38 and 44, the link arms 46 and 48, and the link shaft 50 (50*a* and 50*b*) to the "rigid member" according to the above-described first aspect of the present invention, respectively.

Moreover, in the first embodiment, which has been described above, the link shaft 50 (50*a* and 50*b*) corresponds to the "member connecting shaft" according to the above-described second aspect of the present invention; and the link arms 46 and 48 to the "displacement member" according to the above-described second aspect of the present invention, respectively.

Moreover, in the first embodiment, which has been described above, the projection part 46*b* corresponds to the "engaging part" according to the above-described fourth aspect of the present invention; the first link arm 46 to the "main displacement member" according to the above-described fourth aspect of the present invention; and the second link arm 48 to the "sub displacement member" according to the above-described fourth aspect of the present invention, respectively.

Modified Embodiment of the First Embodiment

Meanwhile, in the first embodiment, which has been described above, the delay mechanism 60 is installed in the rocker shaft 22 as a mechanism that is interposed at some point in the link shaft 50 between #2 cylinder and #3 cylinder. However, the set position of the delay mechanism in the present invention is not limited to the above-described one and may be, for example, a configuration as shown in FIG. 10 hereinafter.

Figure 10:
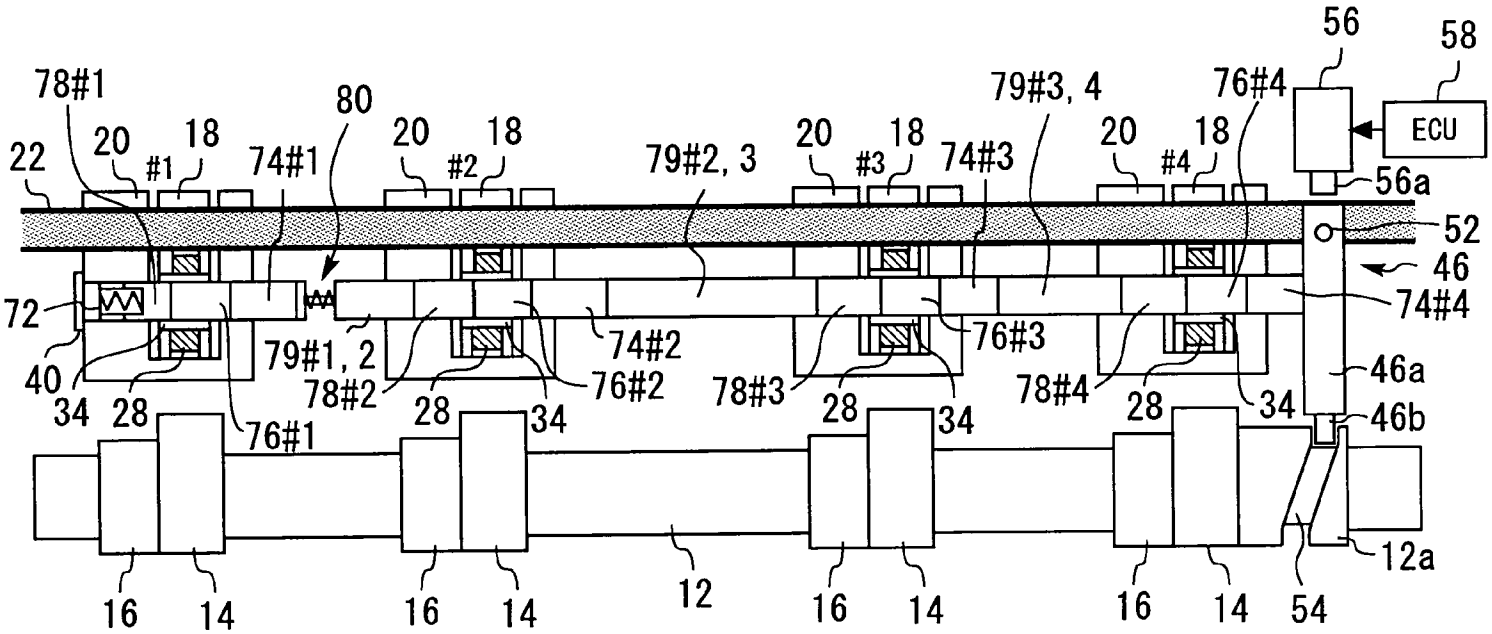
FIG. 10 is a partial cross-sectional view for explaining the configuration of a variable valve operating apparatus in a modified embodiment concerning the first embodiment of the present invention.

FIG. 10 is a partial cross-sectional view for explaining the configuration of a variable valve operating apparatus 70 in a modified embodiment concerning the first embodiment of the present invention. It is noted that in FIG. 10, the same element as that shown in above described FIG. 1 is given the same reference character thereby omitting or simplifying the description thereof. Moreover, FIG. 10 corresponds to the case in which the rocker arms 18 and 20 are put in the connection state.

In the variable valve operating apparatus 70 shown in FIG. 10, the link shaft 50 is not installed in the rocker shaft 22. Further, In the variable valve operating apparatus 70, a return spring 72 provided at only an end part of the second rocker arm 20 for #1 cylinder is interlinked with the first link arm 46 provided for #4 cylinder via changeover pins 74, 76, 78 and 79 provided for each cylinder. That is to say, in the variable valve operating apparatus 70, the first link arm 46 and the changeover pins 74, 76, 78 and 79 provided for each cylinder correspond to the rigid member in the present invention.

In the variable valve operating apparatus 70 having the above-described configuration, a delay mechanism 80 having the same configuration as that of the above-described delay mechanism 60 is provided not in the rocker shaft 22 but between the changeover pin 79#1,2 between #1 and #2 cylinders, and the changeover pin 74#1 for #1 cylinder. According to such configuration, in the wake of the driving of the electromagnetic solenoid 56 performed during the common base-circle section of the main cam 14 relating to #2 to #4 cylinders (see FIG. 9), the operational states of the valves 26 for #2 to #4 cylinders are switched in association with the displacement of the first link arm 46 from the valve operating state to the valve stop state, and then the operational states of the valves 26 for #1 cylinder can be switched with a delay in such a way as to come into the valve stop state from the valve operating state when the common base-circle section of the main cam 14 relating to #1 cylinder arrives. It is, however, preferable to provide the delay mechanism 60 between #2 cylinder and #3 cylinder as in the first embodiment described above because an increase of the contact load between the guide rail 54 and the projection part 46*b* can be prevented due to the fact that the common base-circle section of the main cam 14 can be ensured long; and it is preferable to provide the delay mechanism 60 in the rocker shaft 22 because a dedicated space is not required.

Moreover, instead of the arrangement of the delay mechanism 80 shown in FIG. 10, a delay mechanism having the same configuration as that may be installed between #3 cylinder and #4 cylinder. If it is, however, such a delay mechanism is installed between #3 cylinder and #4 cylinder, compared with the case in which the delay mechanism 80 is installed between #1 cylinder and #2 cylinder, the number of changeover pins that are driven by the repulsion force of a delay mechanism spring that is compressed once at the time of the operation of an magnetic solenoid increases, and the inertia weight of the rigid member driven by the delay mechanism spring increases. Therefore, to smoothly switch the operating characteristics of the valves 26 for each cylinder, it is preferable to install the delay mechanism 80 between #1 cylinder and #2 cylinder rather than install the delay mechanism between #3 cylinder and #4 cylinder. In addition, the delay mechanism according to the present invention may be installed between the respective cylinders.

Moreover, in the present embodiment, which has been described above, the description is made on an example in which the variable valve operating apparatus 10 is applied to the straight four-cylinder engine that does not have the common base-circle section of the main cam 14 among all cylinders when a general operating angle is used for the valve 26. However, the type of the internal combustion engine to be able to be applied to the variable valve operating apparatus according to the present invention is not limited to this. More specifically, if the internal combustion engine has at least two cylinders, various types such as a straight three-cylinder, a V-type six-cylinder or a V-type eight-cylinder may be used. In a case of the straight three-cylinder, there may be no common base-circle section depending on the operating angle of the valve, and even if there is a common base-circle section relating to all cylinders, the section becomes very short. Because of this, in order to avoid the increase in the contact load between the guide rail and the projection part 46*b* due to the displacement of the first link arm within the short common base-circle section, it is preferable to install a delay mechanism as follows. More specifically, for example, it is preferable to integrally form a link shaft for #1 and #2 cylinders and to install a delay mechanism between this link shaft and a link shaft for #3 cylinder. Moreover, in a case of the V-type six-cylinder engine having a first bank made up of #1, #3 and #5 cylinders and a second bank made up of #2, #4 and #6 cylinders, it is preferable to install a delay mechanism under the same concept as that in the case of the straight three-cylinder engine, as follows. For example, it is preferable to integrally form a link shaft for #1 and #3 cylinders and to install a delay mechanism between this link shaft and a link shaft for #5 cylinder; and to integrally form a link shaft for #2 and #4 cylinders and to install a delay mechanism between this link shaft and a link shaft for #6 cylinder. Furthermore, in a case of the V-type eight-cylinder, this can be implemented by applying, to each bank, the configuration of the above-described first embodiment applied to a straight four-cylinder engine.

Moreover, in the present embodiment, which has been described above, the arrangement is made such that the changeover pins 36, 38 and 44 for each cylinder are displaced as a result of the displacements of the first link arm 46 and the link shaft 50 (and further the displacement of the second link arm 48 along with those) taking place during the engagement between the projection part 46*b* of the first link arm 46 and the guide rail 54. Further, the arrangement is made such that the first rocker arm 18 and the second rocker arm 20 are switched between the connection state and the disconnection state by the utilizations of the displacements of the changeover pins 36 and 38, and thereby the operating characteristics of the valves 26 for each cylinder are switched between the valve operating state and the valve stop state However, the variable valve operating apparatus according to the present invention is not limited to the above-described arrangements, providing that it is equipped with a changeover mechanism including an actuator which is shared for at least two cylinders and is driven when the switching the operational states of transfer members for the at least two cylinders; a rigid member which is displaced as a result of the actuation of the actuator to switch the operational states of the transfer members provided for the at least two cylinders; and a delay mechanism which delays the displacement of the rigid member in the cylinders in which the valves are lifting when the actuator is actuated.

Specifically, the above-described rigid member is not limited to the changeover pins 36, 38 and 44, the link arms 46 and 48, and the link shaft 50. That is to say, for example, a variable valve operating apparatus can be configured such that members including two types of cams (referred to as "cam carriers") are attached to a camshaft so as to be movable in the axial direction; such that a connecting body is provided which is made up of the cam carriers for at least two cylinders and which functions as a rigid member according to the present invention; such that the connecting body of the cam carriers which corresponds to the rigid member is displaced in the axial direction of the camshaft as a result of the actuation of an actuator; and such that the operational states of a transfer member are thereby switched in association with a cam, which is abutment with the transfer member, being switched. Then, a delay mechanism according to the present invention may be interposed at some point of such connecting body of the cam carriers. Alternatively, a variable valve operating apparatus having the following arrangements can be applied. To be more specific, for example, if a configuration is provided in which a rocker shaft is allowed to rotatably support a rocker arm corresponding to a transfer member, an arrangement may be made such that the rocker arm on the rocker shaft is displaced in the axial direction of the rocker shaft as a result of the displacement of a rigid member in association with the actuation of an actuator; and such that the operational states of the rocker arm are thereby switched in association with a cam, which is abutment with the rocker arm, being switched. Alternatively, if, for example, a configuration is provided which includes a rocker arm having a roller that is in abutment with a cam, an arrangement may be made such that the roller on a rocker shaft is displaced in the axial direction of a spindle thereof as a result of the displacement of a rigid member in association with the actuation of an actuator; and such that the operational states of the rocker arm (transfer member) are thereby switched in association with the cam, which is abutment with the roller, being switched. Alternatively, if, for example, a configuration is provided in which a rocker shaft corresponding to a rigid member according to the present invention is allowed to rotatably support a rocker arm corresponding to a transfer member, an arrangement may be made such that the rocker shaft itself is displaced in the axial direction thereof as a result of the actuation of an actuator; and such that the operational states of the rocker arm are thereby switched in association with a cam, which is abutment with the rocker arm, being switched.

Moreover, in the first embodiment, which has been described above, although the description is made on an example in which the auxiliary cam 16 is configured as a zero lift cam, the auxiliary cam according to the present invention is not limited to a zero lift cam. That is to say, in the case, for example, of the configuration of the above-described variable valve operating apparatus 10, it may be a cam having a nose part which enables obtaining a smaller lift than that of the main cam 14. According to the configuration having such an auxiliary cam, it becomes possible to switch lift amounts (and/or operating angles) of a valve in two steps by the utilizations of the main cam and the auxiliary cam.

Moreover, in the first embodiment, which has been described above, the arrangement is made such that the driving force of the link shaft 50 at the time of the switching from the valve operating state to the valve stop state is obtained by engaging, by the use of the electromagnetic solenoid 56, the first link arm 46 with the guide rail 54 formed into a helical groove shape; and further such that the biasing force of the return spring 42 applied to the link shaft 50 is utilized as the driving force of the link shaft 50 when returning from the valve stop state by releasing the engagement between the electromagnetic solenoid 56 and the first link arm 46. However, the actuator which displaces the rigid member according to the present invention is not limited to this, and may, for example, drive a link shaft functioning as a rigid member by the use of an electric motor.

Moreover, in the first embodiment, which has been described above, the description is made on an example of the delay mechanism 60 using the biasing force of the delay mechanism spring 64. However, the delay mechanism according to the present invention is not limited to the above-described spring and can apply a liquid, an elastic body or the like, provided that it is configured so as to store a force by constricting when receiving the force at some point of a rigid member, and then so as to be able to release the force stored.

Furthermore, in the first embodiment, which has been described above, the description is made on an example of the variable valve operating apparatus 10 which collectively switches the operating characteristics of the two valves 26 installed for all cylinders of the internal combustion engine having four cylinders. However, the variable valve operating apparatus according to the present invention is not necessarily limited to the one which collectively switches the operating characteristics of a valve installed for all cylinders, provided that it collectively switches the operating characteristics of a valve installed for at least two cylinders. More specifically, it may be configured as an apparatus which collectively switches the operating characteristics of a valve for one or some cylinders out of at least two cylinders of an internal combustion engine having three or more cylinders.

Second Embodiment

Next, a second embodiment of the present invention will be described with reference to FIGS. 11 to 14.

It is assumed that a variable valve operating apparatus 81 according to the present embodiment is configured in the same manner as the variable valve operating apparatus 10 according to the first embodiment described above, except that the configurations shown in FIGS. 12 and 13 described later are added.

Figure 11:
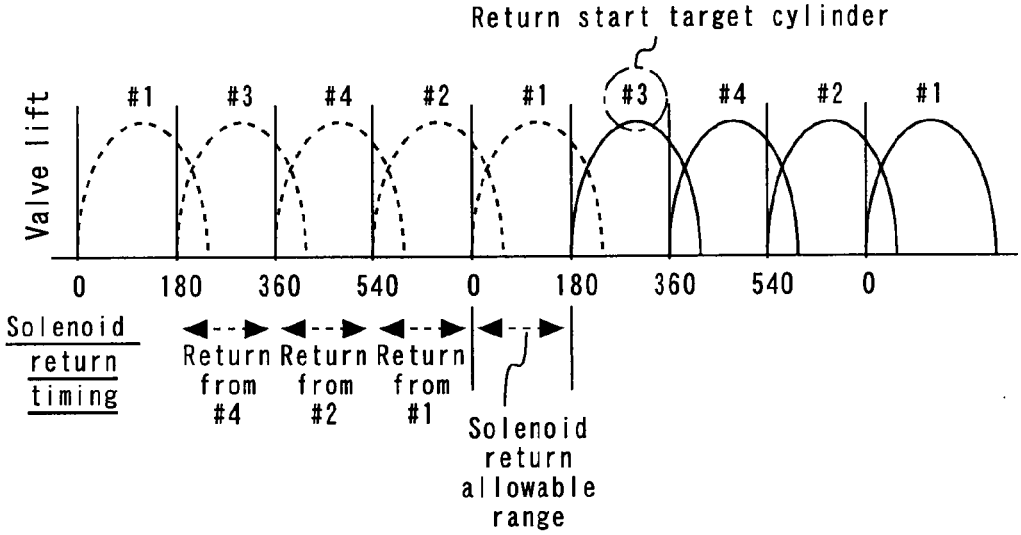
FIG. 11 is a diagram for explaining a problem facing the variable valve operating apparatus of the first embodiment when returning from the valve stop state to the valve operating state.

FIG. 11 is a diagram for explaining a problem facing the variable valve operating apparatus 10 of the above-described first embodiment when returning from the valve stop state to the valve operating state, and its horizontal axis is the crank angle. It is noted that in FIG. 11, the lift curve indicated by the broken line represents a lift curve of a valve in the valve stop state and the lift curve indicated by the solid line represents a lift curve of a valve in the valve operating state.

When switching the operational states of the valves 26 from the valve stop state to the valve operating state during operation of an internal combustion engine, it is required to synchronize a cylinder returning from the valve stop state with a cylinder resuming fuel injection. The reason comes from the fact that the return from the valve stop state without resuming fuel injection causes fresh air to be supplied to a catalyst disposed in an exhaust passage and thereby causes the catalyst to be deteriorated. Moreover, in order to synchronize the cylinder returning from the valve stop state with the cylinder resuming fuel injection, it is required to predetermine a cylinder at which a valve return should be started first.

In the example shown in FIG. 11, it is targeted to start the return of the valves 26 from the valve stop state at #3 cylinder surrounded by a circle mark. In the case of the variable valve operating apparatus 10 that does not has later-described characteristic configurations of the present embodiment, the allowable range of a return timing of the electromagnetic solenoid 56 (a timing that releases the hold of the first link arm 46 by the electromagnetic solenoid 56 by turning OFF the energization of the electromagnetic solenoid 56) is limited to about 180 degrees (in crank angle) immediately before the return at #3 cylinder as shown in FIG. 11 as a "solenoid return allowable range".

The reason comes from the fact as follows. Specifically, in each cylinder, the first link arm 46 (or the second link arm 48) and the changeover pin 44 are merely in abutment with each other. Because of this, when the hold of the second link arms 48 by the electromagnetic solenoid 56 is released at the time of the valve return, the biasing forces of the return springs 42 for the cylinders at which the base-circle section of the main cam 14 is being used allow the changeover pins 36 and 38 for that cylinders to be driven in the advancing direction thereof. This causes the rocker arms 18 and 20 for the cylinders to be switched to the connecting state and causes the link shaft 50 (50*a*, 50*b*) to be displaced to the position at the valve operating state. As a result of that, at cylinders at which the base-circle section of the main cam 14 is not being used (cylinders at which the valve is being lifted), a gap is formed between the first link arm 46 or second link arm 48 that is moved with the link shaft 50, and the changeover pin 44, and thereafter the rocker arms 18 and 20 are switched sequentially to the connecting state from a cylinder at which the base-circle section of the main cam 14 has arrived.

According to the operation at the time of the valve return described so far, as shown in FIG. 11, in a case in which the electromagnetic solenoid 56 is returned during the oscillating operation (hereafter referred to as a "during the lost motion") of a first rocker arm 82 for #3 cylinder in the last cycle with respect to #3 cylinder in a return start cycle, the return is started from #4 cylinder. Similarly, in a case in which the electromagnetic solenoid 56 is returned during the lost motion for #4 cylinder immediately before #3 cylinder in the return start cycle, the return is started from #2 cylinder; and in a case in which the electromagnetic solenoid 56 is returned during the lost motion for #2 cylinder immediately before #3 cylinder in the return start cycle, the return is started from #1 cylinder. In all these three cases, the return comes to be started from a cylinder that is other than #3 cylinder in the return start cycle. Thus, in the case of the configuration of the variable valve operating apparatus 10 of the first embodiment described above, in order to avoid such a situation, it is required to return the electromagnetic solenoid 56 during the lost motion for #1 cylinder immediately before #3 cylinder in the return start cycle. Because of this, the allowable range of the return timing due to variation in responsiveness of the electromagnetic solenoid 56.

Figure 12:
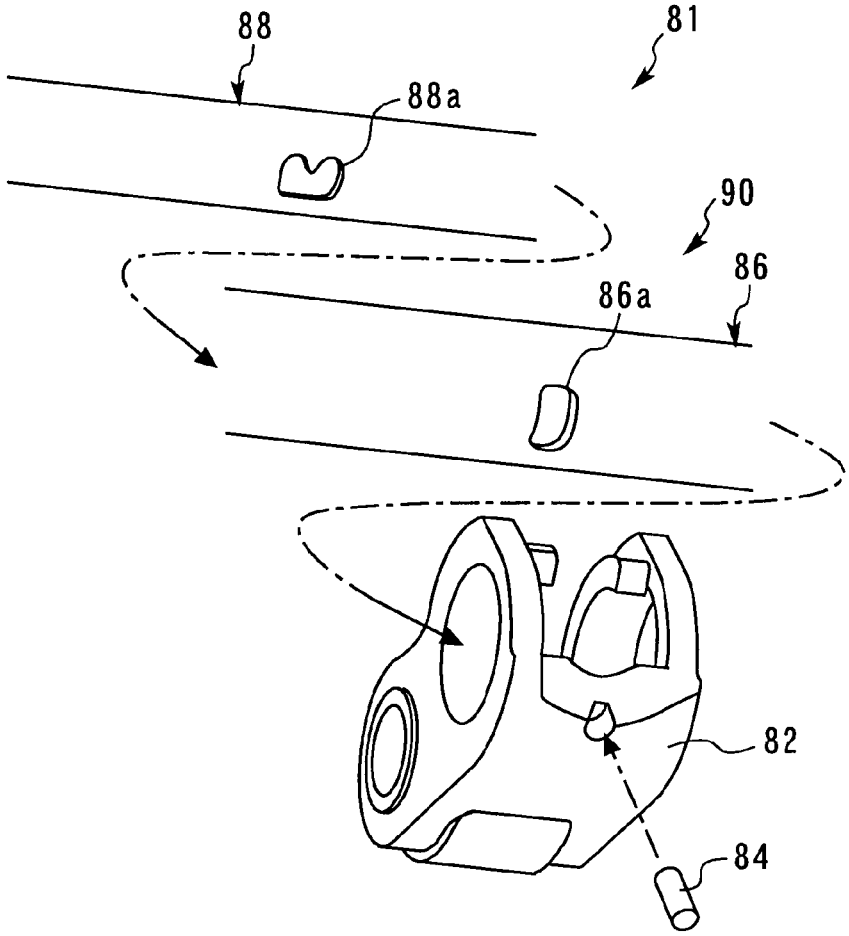
FIG. 12 is a perspective view for illustrating the characteristic configuration included in a variable valve operating apparatus according to a second embodiment of the present invention.

FIG. 12 is a perspective view for illustrating the characteristic configuration included in the variable valve operating apparatus 81 according to the second embodiment of the present invention.

As shown in FIG. 12, a press-fit pin 84 is press-fitted into a rocker-shaft bearing part of the first rocker arm 82 of the present embodiment. Moreover, an elongated hole 86*a* for not interfering with the movement of the press-fit pin 84 in association with the oscillation of the first rocker arm 82 is formed in a rocker shaft 86 at a part supporting the first rocker arm 82. Furthermore, a gate groove 88*a* is formed in a link shaft 88 at a position that is engageable with the press-fit pin 84. The gate groove 88*a* is a groove for restricting the displacements of the link shaft 88 in the axial direction by being subjected to the biasing force of the return spring 42 during a period during which the first rocker arm 82 is performing the oscillating operation by being subjected to the acting force of the main cam 14. In the present embodiment, it is assumed that the above-described configuration shown in FIG. 12 is included in each of #2, #3 and #4 cylinders other than #1 cylinder at which the explosion order is just prior to that of #3 cylinder which is the return start target cylinder.

Figure 13:
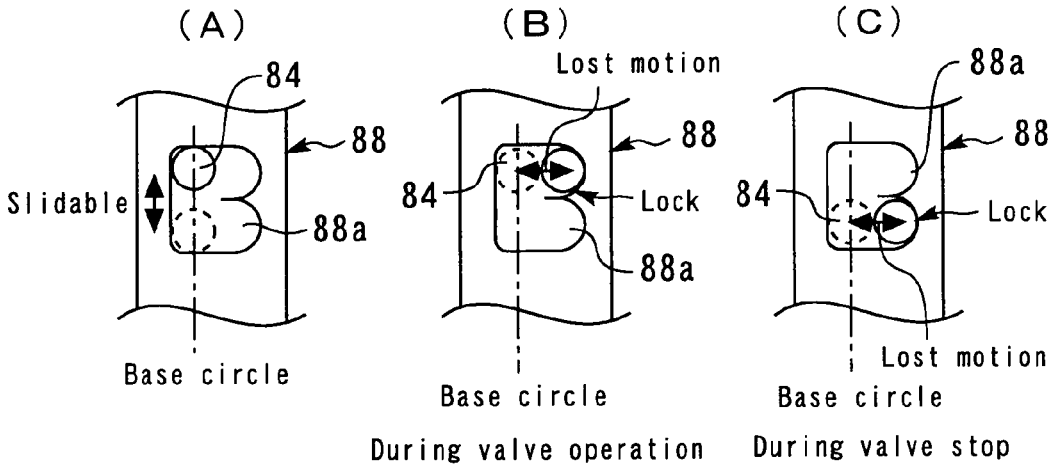
FIG. 13 is a diagram for explaining the relation between the press-fit pin and the gate groove shown in FIG. 12.

FIG. 13 is a diagram for explaining the relation between the press-fit pin 84 and the gate groove 88*a* shown in FIG. 12.

The first rocker arm 82 is configured so as not to move in the axial direction of the rocker shaft 86, and the press-fit pin 84 is press-fitted into such first rocker arm 82. FIG. 13(A) represents a positional relation between the press-fit pin 84 and the gate groove 88*a* in the state in which the main cam 14 is positioned within the base-circle section. In the state shown in this FIG. 13(A), the press-fit pin 84 and the gate groove 88*a* are relatively displaceable as shown by the arrow in FIG. 13(A). Because of this, the link shaft 88 comes to be slideable in the axial direction of the rocker shaft 86.

FIG. 13(B) is a diagram representing how the press-fit pin 84 is operated in synchronization with the oscillating operation of the first rocker arm 82 when the link shaft 88 is located at a position for putting the valves 26 into the valve operating state, and FIG. 13(C) is a diagram representing how the press-fit pin 84 is operated in synchronization with the oscillating operation of the first rocker arm 82 when the link shaft 88 is located at a position for putting the valves 26 into the valve stop state. As shown in FIGS. 13(B) and 13(C), the press-fit pin 84 is engaged with the gate groove 88*a* when the first rocker arm 82 is performing the oscillating operation by being subjected to the acting force of the main cam 14 (at the time of the lost motion). As a result of this, the link shaft 88 comes not to slide in the axial direction of the rocker shaft 86 at the time of the lost motion of the first rocker arm 82.

Figure 14:
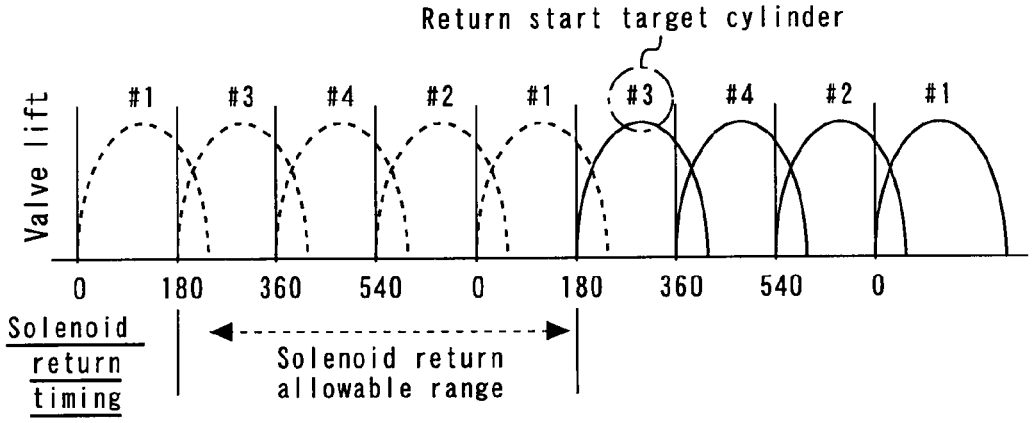
FIG. 14 is a diagram for explaining advantages of having the configurations shown in FIGS. 12 and 13.

FIG. 14 is a diagram for explaining advantages of having the configurations shown in FIGS. 12 and 13.

The variable valve operating apparatus 81 of the present embodiment implements a restricting mechanism 90 that restricts, by the utilizations of the press-fit pin 84 and the gate groove 88*a* described so far, the link shaft 88 in such a way as not to be displaced in the axial direction by being subjected to the biasing force of the return spring 42 during the period during which the first rocker arm 82 is performing the oscillating operation by being subjected to the acting force of the main cam 14, and that permits the slide operation of the link shaft 88 within only the base-circle section. Further, the restricting mechanism 90 is installed for each of #2, #3 and #4 cylinders. This makes it possible to restrict the link shaft 88 in such a way as not to be displaced in the axial direction by being subjected to the biasing force of the return spring 42 during the period during which the first rocker arm 82 provided for any of #2, #3 and #4 cylinders is performing the oscillating operation by being subjected to the acting force of the main cam 14 in the valve stop state.

As a result of that, even if the electromagnetic solenoid 56 is returned during the lost motion of any of #2, #4 and #3 cylinders before #3 cylinder of the return start cycle as well as the case of returning the electromagnetic solenoid 56 during the lost motion of #1 cylinder immediately before #3 cylinder of the return start cycle, the link shaft 88 is displaced to the position for putting the valves 26 into the valve stop state during the lost motion of #1 cylinder immediately before #3 cylinder of the return start cycle. When the valve return is performed with #3 cylinder surrounded by a circle as a target, the return timing of the electromagnetic solenoid 56 can be therefore enlarged to a range shown in FIG. 14 as a "solenoid return allowable range" (720° in crank angle). In this way, the restricting mechanism 90 of the present embodiment can perform the return to the valve operating state from a particular cylinder, while enlarging the range allowing a variation of response of the electromagnetic solenoid 56 at the time of the valve return.

The "solenoid return allowable range" as shown in FIG. 14 varies with the number of the cylinders having the restricting mechanism 90. More specifically, the "solenoid-return allowable range" in FIG. 14 can be enlarged to about 360 degrees in crank angle if the restricting mechanism 90 is installed for #2 cylinder only, and can be enlarged to about 540 degrees in crank angle if the restricting mechanism 90 is installed for each of #2 and #4 cylinders. Installing the restricting mechanism 90 for each of #2, #3 and #4 cylinders as in the present embodiment therefore permits the range allowing a variation of response of the electromagnetic solenoid 56 at the time of the valve return to be enlarged at a maximum.

It is noted that in the second embodiment, which has been described above, the return spring 42 corresponds to the "biasing means" according to the above-described fifth aspect of the present invention; and the restricting mechanism 90 to the "restricting means" according to the above-described fifth aspect of the present invention, respectively.

Third Embodiment

Next, a third embodiment of the present invention and a modified embodiment thereof will be described with reference to FIGS. 15 to 18.

Figure 15:
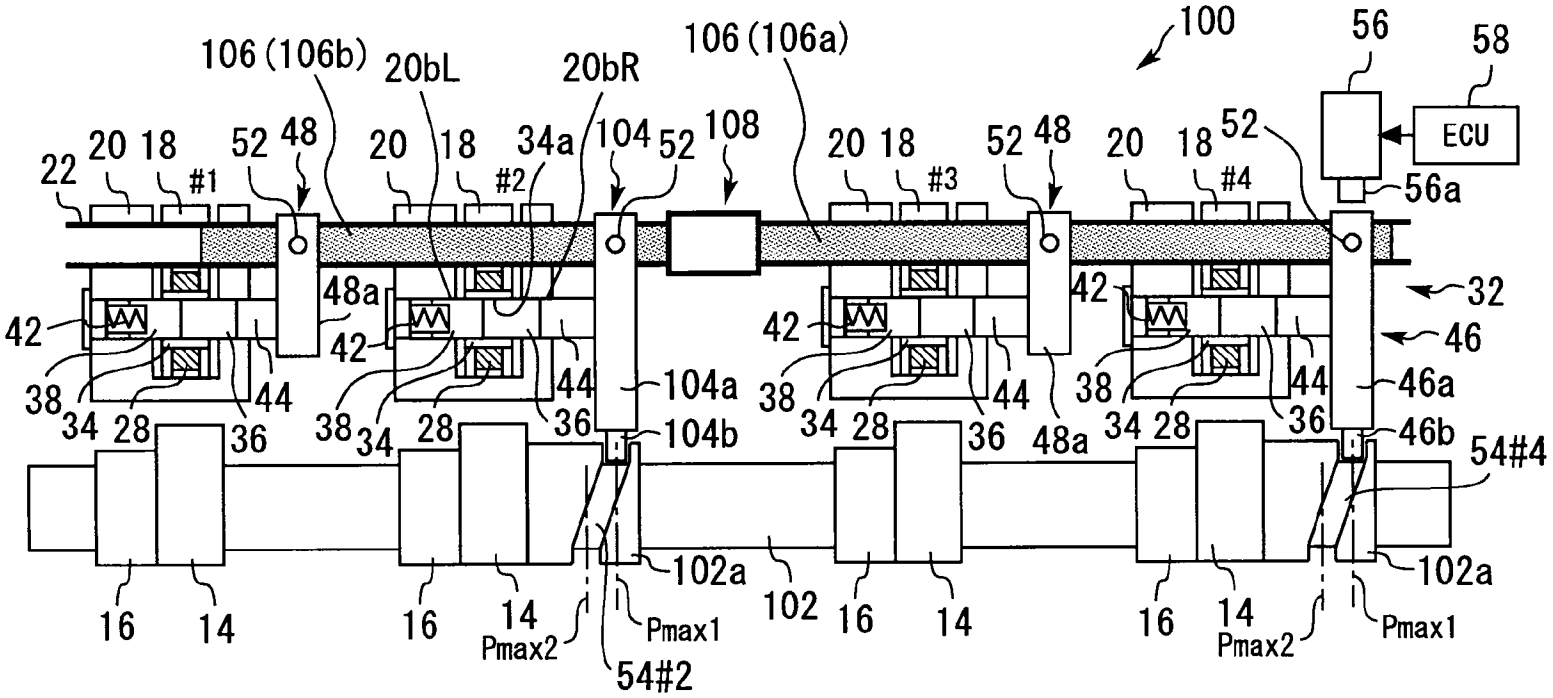
FIG. 15 is a schematic diagram showing the overall configuration of a variable valve operating apparatus for an internal combustion engine according to a third embodiment of the present invention.
Figure 16:
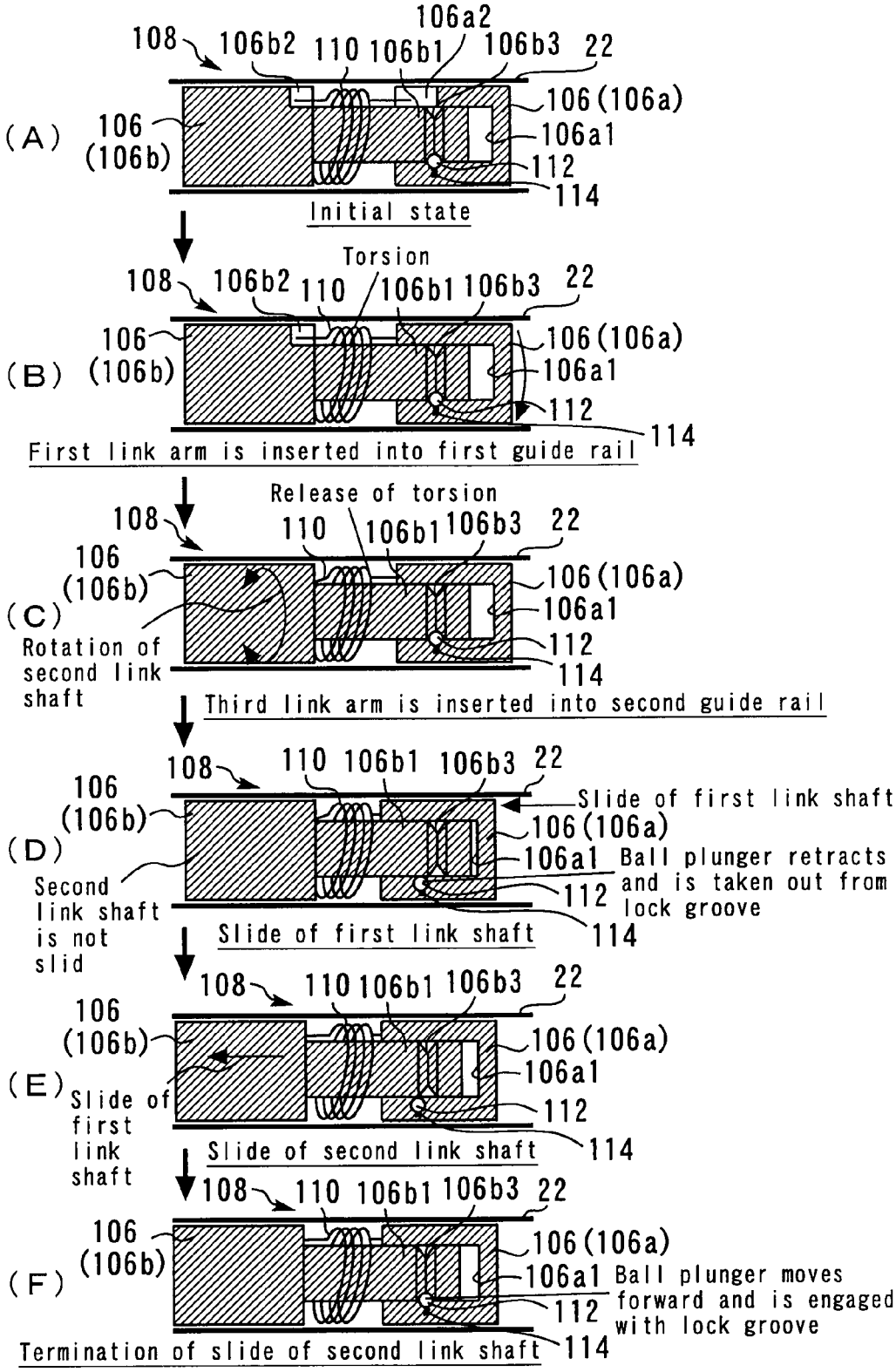
FIG. 16 is a diagram for illustrating a detailed configuration of the delay mechanism shown in FIG. 15.

It is assumed that a variable valve operating apparatus 100 according to the present embodiment is configured in the same manner as the variable valve operating apparatus 10 according to the first embodiment described above, except that the configuration relating to #2 cylinder and the configuration of a delay mechanism 108 differ as shown in FIGS. 15 and 16 described later.

FIG. 15 is a schematic diagram showing the overall configuration of the variable valve operating apparatus 100 for an internal combustion engine according to the third embodiment of the present invention. It is noted that in FIG. 15, the same element as that shown in above-described FIG. 1 is given the same reference character thereby omitting or simplifying the description thereof.

The variable valve operating apparatus 10 according to the first embodiment described above makes it possible to collectively and smoothly switch the operational states of the valves 26 provided for all cylinders by the utilization of the single electromagnetic solenoid 56. The variable valve operating apparatus 10, however, is configured to collectively switch the operational states of the valves 26 for all cylinders using the single guide rail 54. This makes it possible to achieve a simplified configuration, but the load acting on the contact part between the guide rail 54 and the projection part 46*b* increases. For this reason, there is a concern that wear between the guide rail 54 and the projection part 46*b* increases.

Accordingly, as shown in FIG. 15, the variable valve operating apparatus 100 according to the present embodiment includes a guide rail 54 formed into a helical groove in the outer surface of a circular column part 102*a* of a camshaft 102 for #2 cylinder belonging to the second cylinder group (hereinafter, referred to as a "second guide rail 54#2"), in addition to a guide rail 54 installed for #4 cylinder belonging to the first cylinder group (hereinafter, referred to as a "first guide rail 54#4"). That is to say, in the present embodiment, an arrangement is made such that the operational states of the valves 26 for all cylinders are collectively switched using the single electromagnetic solenoid 56, and a total of two guide rails 54, each one of which is installed for each cylinder.

To achieve the above-described function, the link arm for #2 cylinder is configured as a third link arm 104 that provides the distal end of an arm part 104*a* with a second projection part 104*b* engageable with the second guide rail 54#2. The third link arm 104 is fixed to a second link shaft 106*b* via the press-fit pin 52 in the same manner as the second link arm 48 for #1 cylinder. It is noted that the electromagnetic solenoid 56 is not installed for #2 cylinder, and thus a pressing surface pressed by the electromagnetic solenoid 56 is not formed on the third link arm 104 for #2 cylinder contrary to the first link arm 46 for #4 cylinder.

Moreover, also in the present embodiment, the delay mechanism 108 is interposed at some point in the link shaft 106 between #2 cylinder and #3 cylinder (that is, between the first cylinder group and the second cylinder group). This delay mechanism 108 is configured as a mechanism that transfers the rotational force of the first link arm 46 by the electromagnetic solenoid 56 to the third link arm 104 with a delay.

FIG. 16 is a diagram for illustrating a detailed configuration of the delay mechanism 108 shown in FIG. 15.

FIG. 16(A) shows a operational state of the delay mechanism 108 during operation of the valve (initial state). A cylindrical concave part 106*a*1 is formed at a portion opposite to the second link shaft 106*b* in the first link shaft 106*a*. Moreover, a circular column part 106*b*1, the distal end of which is inserted into the concave part 106*a*1 in such a way as to be displaceable in the axial direction, is formed on the second link shaft 106*b*.

As shown in FIG. 16, a torsion coil spring 110 is wound around the circular column part 106*b*1 interposed between the first link shaft 106*a* and the second link shaft 106*b*. A latch part 106*a*2 that latches one end of the torsion coil spring 110 is formed at an end part of the first link shaft 106*a*, and a latch part 106*b*2 that latches the other end of the torsion coil spring 110 is formed at an end part of the second link shaft 106*b*. Such configuration makes it possible to produce the biasing force of the torsion coil spring 110 when the first link shaft 106*a* and the second link shaft 106*b* are relatively rotated. It is noted that the configuration is made such that the torsion coil spring 110 does not produce a biasing force in the initial state.

Furthermore, a ball plunger 112 is disposed on the peripheral surface of the concave part 106*a*1. The ball plunger 112 is biased toward the circular column part 106*b*1 by a spring 114. A ring-like lock groove 106*b*3 that is engageable with the ball plunger 112 is formed on the circular column part 106*b*1. The lock groove 106*b*3 is provided at a position that is engageable with the ball plunger 112 in the initial state shown in FIG. 16(A).

Figure 17:
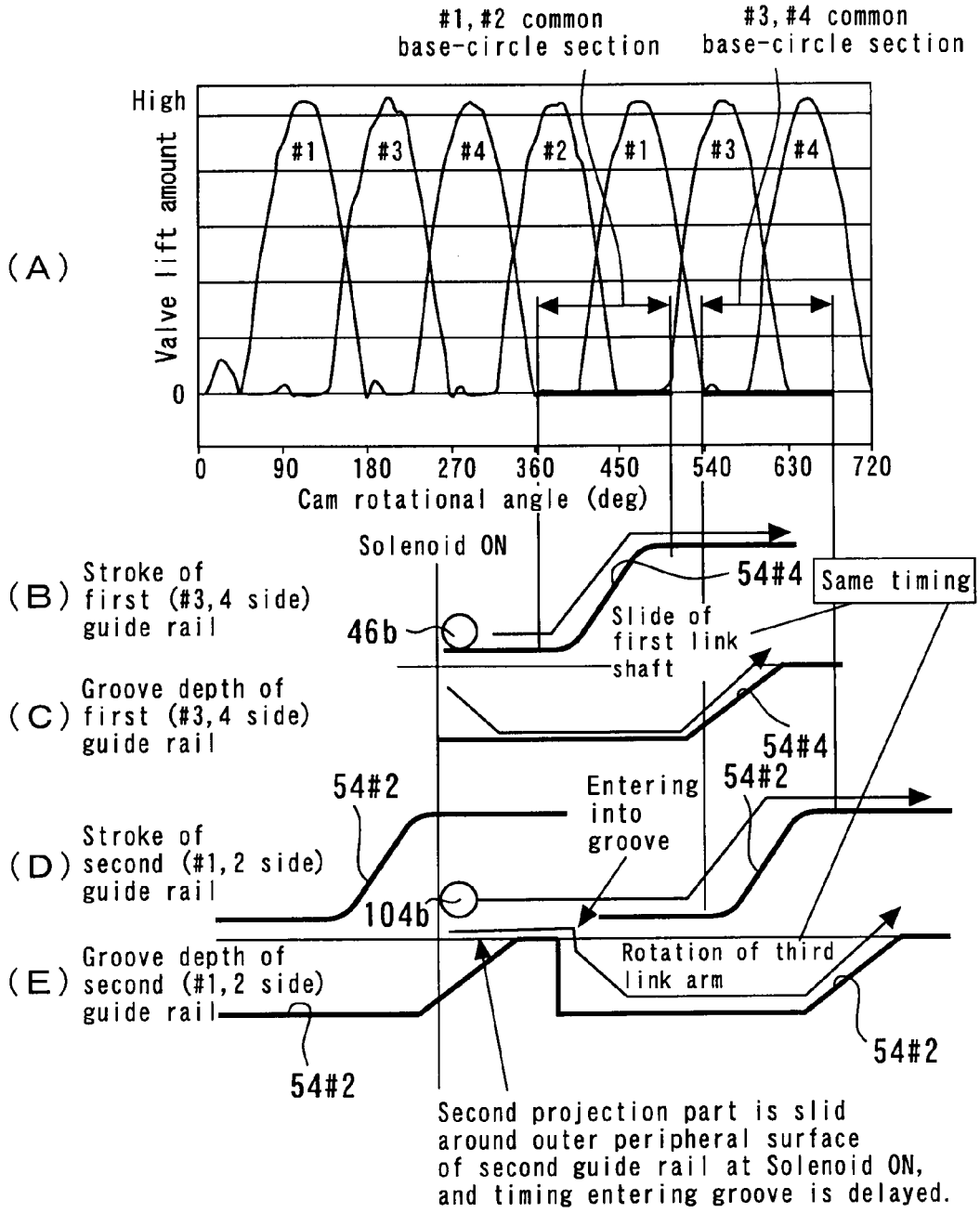
FIG. 17 is a diagram for explaining the operation of the delay mechanism shown in FIG. 15.

Next, the operation of the delay mechanism 108 when the operational states of the valves 26 are switched from the valve operating state to the valve stop state will be described with newly reference to FIG. 17 as well as above FIG. 16. FIG. 17 is a diagram for explaining the operation of the delay mechanism 108 shown in FIG. 15. To be more specific, FIG. 17(A) collectively represents lift curves of the valves 26 for each cylinder; FIG. 17(B) shows the stroke of the first guide rail 54#4 (for #3 and #4); FIG. 17(C) shows the groove depth of the first guide rail 54#4 (for #3 and #4); FIG. 17(D) shows the stroke of the second guide rail 54#2 (for #1 and #2); and FIG. 17(E) shows the groove depth of the second guide rail 54#2 (for #1 and #2).

If the energization of the electromagnetic solenoid 56 is performed in the initial state shown in FIG. 16(A), the state shown in FIG. 16(B) is achieved. More specifically, the first link shaft 106*a* is rotated with the first link arm 46 as a result of the actuation of the electromagnetic solenoid 56, and thereby the projection part 46*b* of first link arm 46 (in the present embodiment, especially referred to as the "first projection part") is inserted into the first guide rail 54#4 as shown in FIG. 17(C). Immediately after starting the energization of the electromagnetic solenoid 56, the projection part 104*b* of the third link arm 104 comes into contact with the outer peripheral surface of the second guide rail 54#2 as shown in FIG. 17(E), and thus the rotations of the third link arm 104 and the second link shaft 106*b* fixed thereto become restricted. As a result of that, the torsion coil spring 110 is twisted by relative rotations between the first link shaft 106*a* and the second link shaft 106*b*. Consequently, the torsion coil spring 110 comes into a state that stores the repulsion force.

If a timing that allows the second projection part 104*b* to be inserted into the second guide rail 54#2 is reached after that, the third link shaft 104 is rotated with the second link shaft 106*b* by the repulsion force (biasing force) of the torsion coil spring 110 as shown in FIG. 16(C). As a result of this, the second projection part 104*b* is inserted into the second guide rail 54#2 as shown in FIG. 17(E).

Then, at the substantially same timing as when the second projection part 104*b* is inserted into the second guide rail 54#2, the first projection part 46*b* comes close to the inclined section of the first guide rail 54#4 as shown in FIG. 17(E). At the timing, the common base-circle section of the main cam 14 relating to #1 and #2 cylinders is being reached as shown in FIG. 17(A). Therefore, the first link shaft 106*a* starts being displaced (slid) with the first link arm 46 as shown in FIGS. 16(D) and 17(B), and thereby the engagement between the ball plunger 112 and the lock groove 106*b*3 are released. Moreover, in this stage, the second projection part 104*b* is passing through the straight section of the second guide rail 54#2 as shown in FIG. 17(D). The second link shaft 106*b* has been therefore not yet displaced.

If, after that, the second projection part 104*b* comes close to the inclined section of the second guide rail 54#2, the common base-circle section of the main cam 14 relating to #3 and #4 cylinders is reached as shown in FIGS. 17(A) and 17(D. Therefore, the second link shaft 106*b* starts being displaced (slid) with the third link arm 104 as shown in FIGS. 16(E) and 17(D). Then, when the displacement of the second link shaft 106*b* is completed, the ball plunger 112 goes forward to be engaged with the lock groove 106*b*3 as shown in FIG. 16(F). As a result of that, in a situation in which the operational states of the valves 26 are changed from the valve operation state to the valve stop state, the operation of the delay mechanism 108 is completed.

The delay mechanism 108 described so far can rotate the third link arm 104 with a delay with respect to the rotation of the first link arm 46 as a result of the actuation of the electromagnetic solenoid 56. This makes it possible to increase the number of the guide rails 54 without increasing the number of the electromagnetic solenoids 56. Further, in the variable valve operating apparatus 100 including the single electromagnetic solenoid 56 and one guide rail 54 provided for each of both the cylinder groups, it becomes possible to collectively and smoothly switch the operational states of the valves 26 for all cylinders from the valve operating state to the valve stop state.

Moreover, it is possible to reduce the number of the cylinders that the individual guide rail 54 assumes, because one guide rail 54 for each cylinder is installed. This makes it possible to decrease the contact load acting on each guide rail 54. Each guide rail 54 can be therefore prevented from wearing.

Furthermore, as described above, a lock mechanism using the ball plunger 112 and the lock groove 106*b*3 is provided between the first link shaft 106*a* and the second link shaft 106*b*. The axial position of the second shaft 106*b* can be therefore held in such a way that the second link shaft 106*b* is independently not returned to the position at the time of the valve operating state by the biasing forces of the return springs 42 for #1 and #2 cylinders during performance of the valve state control.

In the third embodiment, which has been described above, the description is made on an example of the variable valve operating apparatus 100 including the single electromagnetic solenoid 56 and the guide rails 54 and one guide rail 54 provided for each of both the cylinder groups. This is, however, not the only possible arrangement for the present invention. To decrease more the contact load between the guide rail and the engaging part of the main displacement member, a variable valve operating apparatus 120 having the following configuration shown in FIG. 18 may be, for example, provided.

Figure 18:
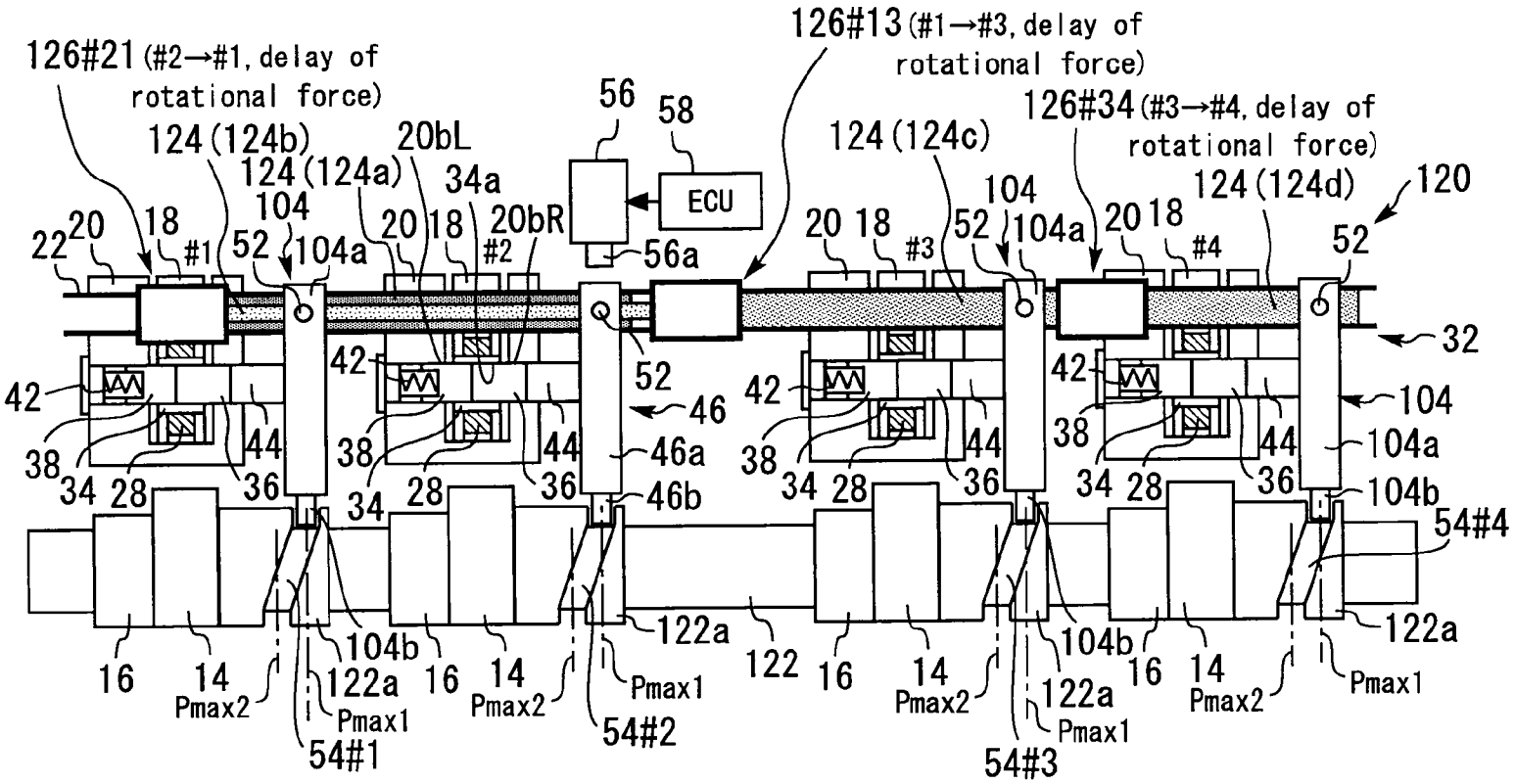
FIG. 18 is a schematic diagram showing the overall configuration of a variable valve operating apparatus for an internal combustion engine according to a modified example of the third embodiment of the present invention.

FIG. 18 is a schematic diagram showing the overall configuration of the variable valve operating apparatus 120 for an internal combustion engine according to a modified example of the third embodiment of the present invention. It is noted that in FIG. 18, the same element as that shown in above-described FIG. 16 is given the same reference character thereby omitting or simplifying the description thereof.

As shown in FIG. 18, the variable valve operating apparatus 120 includes a single electromagnetic solenoid 56, and guide rails 54#1, 54#2, 54#3 and 54#4 that are formed in the outer peripheral surface of the respective circular column parts 122*a* for each cylinder on a camshaft 122.

Moreover, in the configuration shown in FIG. 18, the first link arm 46 having the projection part 46*b* and the pressing surface 46*c* is used as a link arm for #2 cylinder, and the third link arm 104 having the projection part 104*b* is used as each link arm for the other #1, #3 and #4 cylinders.

Moreover, the configuration shown in FIG. 18 includes a link shaft 124 which is incorporated into the rocker shaft 22 and divided into four pieces. To be more specific, a first link arm 124*a* that is formed into a hollow shape is integrally coupled with the first link arm 46 for #2 cylinder via the press-fit pin 52. A second link shaft 124*b* is installed inside the first link shaft 124*a* and is integrally coupled with the third link arm 104 for #1 cylinder via the press-fit pin 52. A third link shaft 124*c* is integrally coupled with the third link arm 104 for #3 cylinder via the press-fit pin 52. A fourth link shaft 124*d* is integrally coupled with the third link arm 104 for #4 cylinder via the press-fit pin 52.

Furthermore, the configuration shown in FIG. 18 includes three delay mechanisms 126#21, 126#13 and 126#34. This delay mechanism 126#21 and the like are supposed to have the same configuration as the above-described delay mechanism 108 with the torsion coil spring 110 and to be a mechanism that transfers the rotational force of the input side link shaft to the other link shafts with a delay. To be more specific, the delay mechanism 126#21 is a mechanism that transfers, to the second link shaft 124*b* with a delay, the force generated by the rotation of the first link shaft 124*a* via the first link arm 46 as a result of the actuation of the electromagnetic solenoid 56. The delay mechanism 126#13 is a mechanism that transfers the rotational force of the second link shaft 124*b* to the third link shaft 124*c* with a delay. In the same manner, the delay mechanism 126#34 is a mechanism that transfers the rotational force of the third link shaft 124*c* to the fourth link shaft 124*d* with a delay.

As already described, the explosion order of the internal combustion engine described in the present description is #1 to #3, to #4, and to #2. According to the configuration shown in FIG. 18, the rotational force of the first link arm 46 for #2 cylinder by the electromagnetic solenoid 56 is transferred in sequence to the third link arm 104 for #1 cylinder, the third link arm 104 for #3 cylinder, and the third link arm 104 for #4 cylinder, with a sequential delay. This makes it possible to collectively and smoothly switch the operational states of the valves 26 for all cylinders from the valve operating state to the valve stop state in the variable valve operating apparatus 120 including the single electromagnetic solenoid 56 and one guide rail 54 installed for each of all cylinders. In addition, according to the configuration including the guide rails 54 for all cylinders in this manner, the contact load acting on the individual guide rail 54 can be sufficiently reduced.

It is noted that in the third embodiment, which has been described above, the first link shaft 106*a* corresponds to the "first member connecting shaft" according to the above-described seventh aspect of the present invention; the second link shaft 106*b* to the "second member connecting shaft" according to the above-described seventh aspect of the present invention; the first projection part 46*b* to the "first engagement part" according to the above-described seventh aspect of the present invention; the first link arm 46 to the "first main displacement member" according to the above-described seventh aspect of the present invention; the second link arm 48 for #3 cylinder to the "first sub displacement member" according to the above-described seventh aspect of the present invention; the second projection part 104*b* to the "second engagement part" according to the above-described seventh aspect of the present invention; the third link arm 104 to the "second main displacement member" according to the above-described seventh aspect of the present invention; the second link arm 48 for #1 cylinder to the "second sub displacement member" according to the above-described seventh aspect of the present invention; and the delay mechanism 108 to the "delay mechanism" according to the above-described seventh aspect of the present invention, respectively.

Fourth Embodiment

Next, a fourth embodiment of the present invention will be described with reference to FIGS. 19 and 20.

Figure 19:
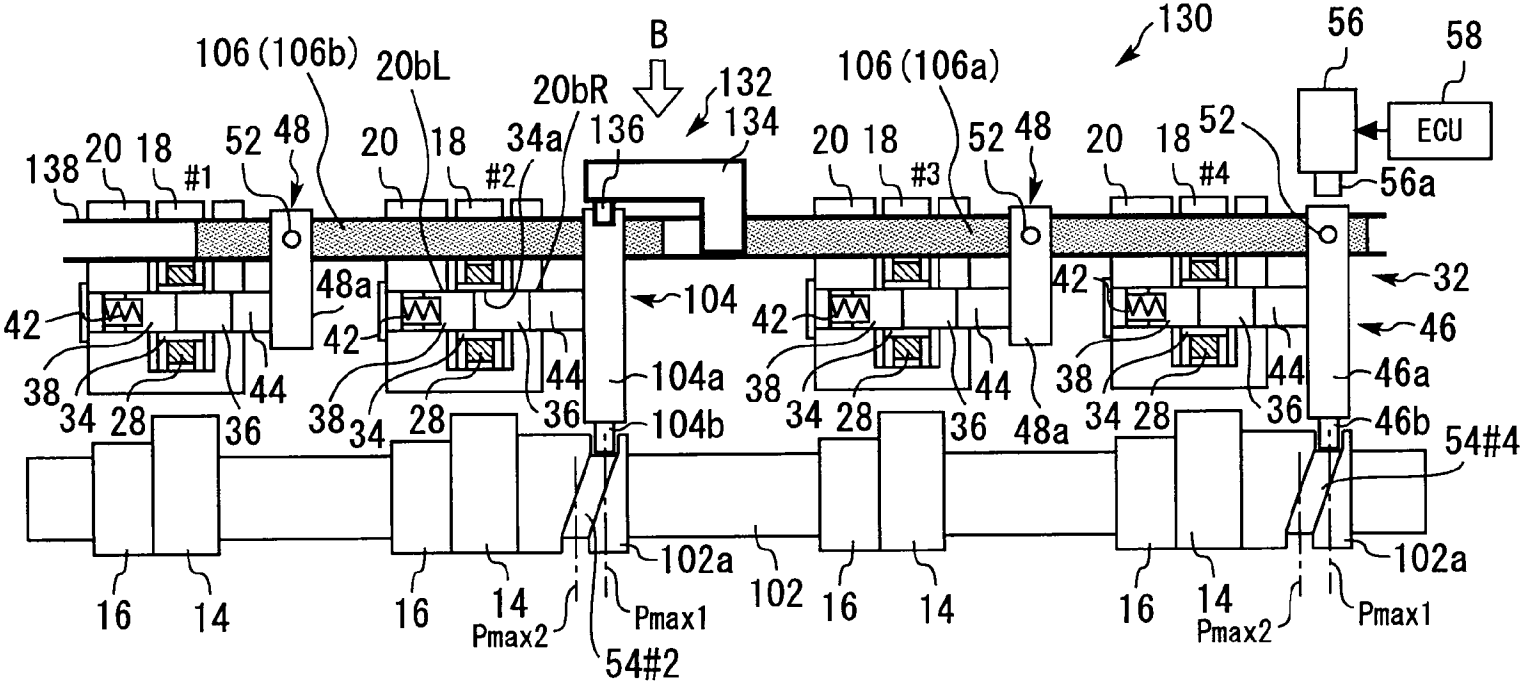
FIG. 19 is a schematic diagram showing the overall configuration of a variable valve operating apparatus for an internal combustion engine according to a fourth embodiment of the present invention.
Figure 20:
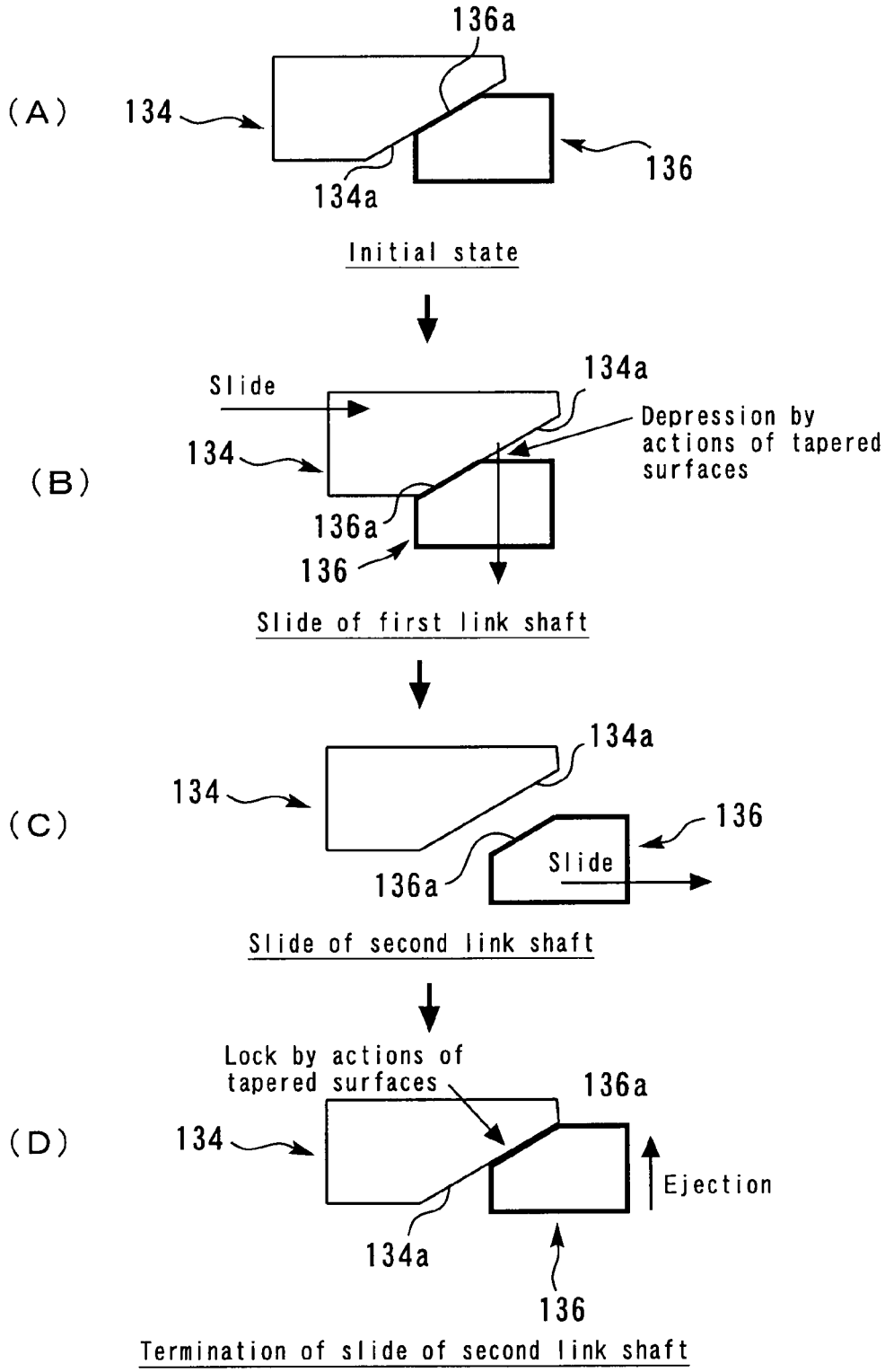
FIG. 20 is a view of a delay mechanism seen from the direction shown by the arrow B in FIG. 19.

It is assumed that a variable valve operating apparatus 130 according to the present embodiment is configured in the same manner as the variable valve operating apparatus 100 according to the third embodiment described above, except that the configuration of a delay mechanism 132 differs as shown in FIGS. 19 and 20 described later.

FIG. 19 is a schematic diagram showing the overall configuration of a variable valve operating apparatus 130 for an internal combustion engine according to the fourth embodiment of the present invention. It is noted that in FIG. 19, the same element as that shown in above-described FIG. 15 is given the same reference character thereby omitting or simplifying the description thereof.

The delay mechanism 132 according to the present embodiment is a mechanism that rotates the third link arm 104 for #2 cylinder at a timing later than that of the first link arm 46 for #4 cylinder by rotating the third link arm 104 for #2 cylinder using the displacement of the first link shaft 106*a* that takes place during the engagement between the first projection part 46*b* and the first guide rail 54#4.

Next, the detailed configuration of the delay mechanism 132 and the operation thereof will be described with newly reference to FIG. 20 in addition to above FIG. 19. FIG. 20 is a view of the delay mechanism 132 seen from the direction shown by the arrow B in FIG. 19.

As shown in FIG. 19, a first fixing member 134 is fixed to the end part of the second link shaft 106*b* side of the first link shaft 106*a*. Moreover, the third link arm 104 for #2 cylinder is fixed to the second shaft 106*b* using a second fixing member (press-fit pin) 136. It is noted that an elongate hole (not shown) is formed in a rocker shaft 138 to allow the displacement of the first fixing member 134 in synchronization with the first link shaft 106*a*.

As shown in FIG. 20, there is provided on the first fixing member 134, a first tapered surface 134*a* which is formed in such a way that its width narrows toward the third link arm 104 side. Moreover, there is provided on the second fixing member 136, a second tapered surface 136*a* which is in surface contact with the first tapered surface 134*a*.

FIG. 20(A) shows the operational state of the delay mechanism 132 at the time of the valve operating state (initial state). If the energization of the electromagnetic solenoid 56 is performed in this initial state, the first projection part 46*b* of the first link arm 46 is engaged with the first guide rail 54#4 and the first link shaft 106*a* starts being displaced (slid). On this occasion, as shown in FIG. 20(B), the first fixing member 134 starts being (slid) toward the second fixing member 136 as a result of the displacement of the first link shaft 106*a*. As a result of this, the actions of the tapered surface 134*a* and 136*a* causes the second fixing member 136 to be pushed downward. Because of this, the third link arm 104 rotates, and the second projection part 104*b* is engaged with the second guide rail 54#2.

Thereafter, as a result of the engagement between the second projection part 104*b* and the second guide rail 54#2, the second fixing member 136 and second link shaft 106*b* that are fixed to the third link arm 104 start being displaced (slid) as shown in FIG. 20(C). Then, when the sliding operation of the second link shaft 106*b* is terminated, the second projection part 104*b* is taken out from the second guide rail 54#2 by the action of the shallow bottom part 54*c* of the guide rail 54#2, and the first tapered surface 134*a* and the second tapered surface 136*a* come again into contact with each other as shown in FIG. 20(D). In this case, the axial position of the second link shaft 106*b* is held using the actions of the tapered surfaces 134*a* and 136*a* so that the second link shaft 106*b* is not returned to the position at the time of the valve operating state by itself by the biasing forces of the return springs 42 for #1 and 2 cylinders.

As described so far, the delay mechanism 132 of the present embodiment can convert, with a delay, the sliding force of the first link shaft 106*a* taking place during the engagement between the first projection part 46*b* and the first guide rail 54#4, into the rotational force of the third link arm 104 via the tapered surfaces 134*a* and 136*a*. More specifically, the third link arm 104 can be rotated with a delay with respect to the rotation of the first link arm 46 as a result of the energization of the electromagnetic solenoid 56. By the use of the arrangement described above, it is also made possible to increase the number of the guide rails 54 without increasing the number of the electromagnetic solenoids 56. Further, in the variable valve operating apparatus 130 that includes the single electromagnetic solenoid 56 and one guide rail 54 provided for each of both the cylinder groups, the operational states of the valves 26 for all cylinders can be switched collectively and smoothly from the valve operating state to the valve stop state, while reducing the contact loads between the respective guide rails 54#4, 54#2 and the respective projection parts 46*b*, 104*b*.

Moreover, the configuration of the present embodiment can rotate the third link arm 104 using the sliding force of the first link shaft 106*a* that is generated from the rotational force of the main cam 14. Therefore, energy for twisting the torsion coil spring 110 is not required in contrast to the third embodiment described above. As a result, the driving force of the electromagnetic solenoid 56 can be reduced compared with the arrangement of the third embodiment.

Meanwhile, in the fourth embodiment, which has been described above, the description is made on an example of the configuration in which the first tapered surface 134*a* is formed on the first fixing member 134 fixed to the first link shaft 106*a* and in which the second tapered surface 136*a* is formed on the second fixing member 136 fixed to the third link arm 104. The present invention is, however, not limited to this. Specifically, the first tapered surface may be formed directly on the first member connecting shaft (for example, the first link shaft 106*a*) and the second tapered surface may be formed directly on the second main displacement member (for example, the third link arm 104).

It is noted that in the fourth embodiment, which has been described above, the first link shaft 106*a* corresponds to the "first member connecting shaft" according to the above-described ninth aspect of the present invention; the second link shaft 106*b* to the "second member connecting shaft" according to the above-described ninth aspect of the present invention; the first projection part 46*b* to the "first engagement part" according to the above-described ninth aspect of the present invention; the first link arm 46 to the "first main displacement member" according to the above-described ninth aspect of the present invention; the second link arm 48 for #3 cylinder to the "first sub displacement member" according to the above-described ninth aspect of the present invention; the second projection part 104*b* to the "second engagement part" according to the above-described ninth aspect of the present invention; the third link arm 104 to the "second main displacement member" according to the above-described ninth aspect of the present invention; the second link arm 48 for #1 cylinder to the "second sub displacement member" according to the above-described ninth aspect of the present invention; and the delay mechanism 132 to the "delay mechanism" according to the above-described ninth and tenth aspects of the present invention, respectively.

Fifth Embodiment

Next, a fifth embodiment of the present invention will be described with reference to FIG. 21.

Figure 21:
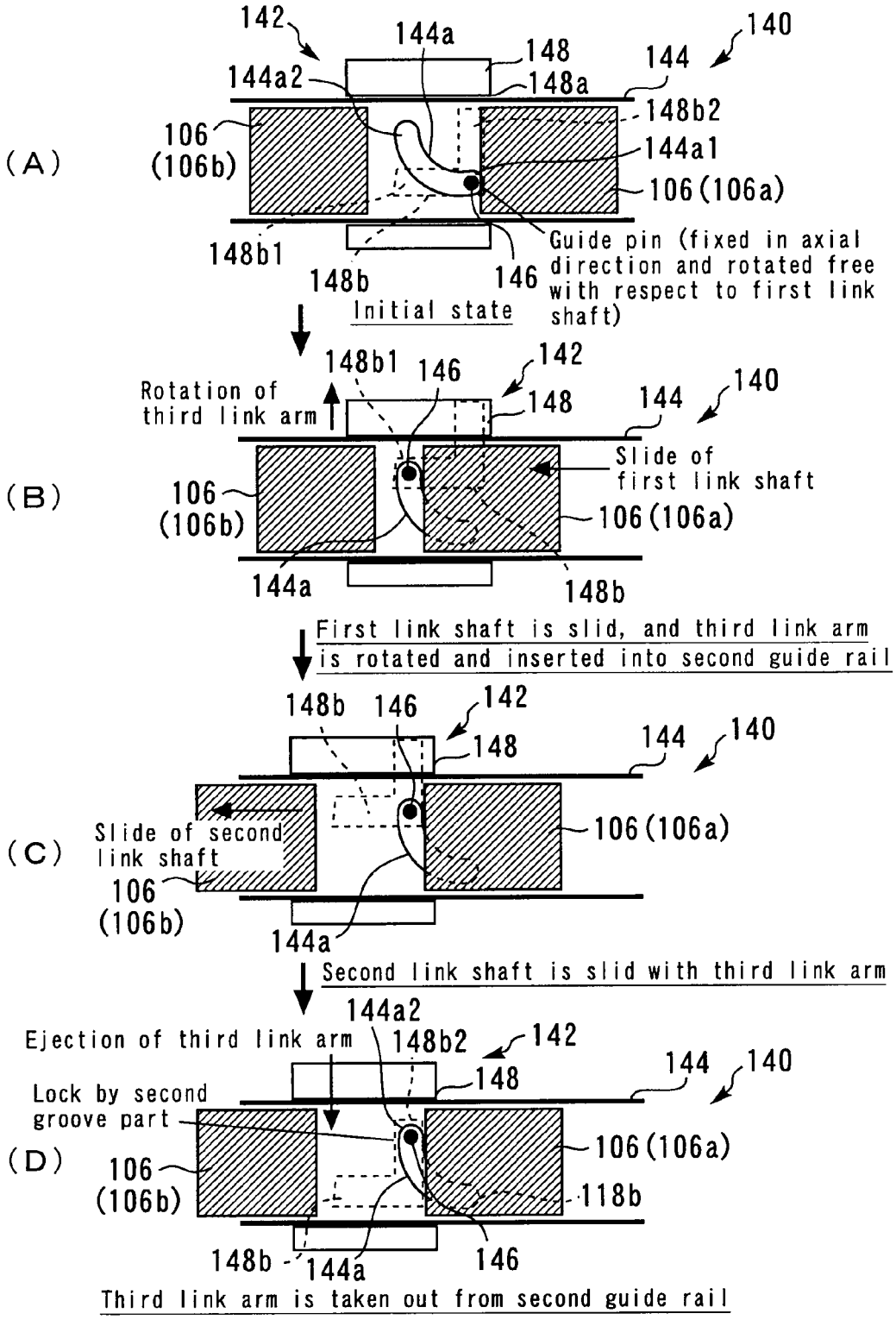
FIG. 21 is a diagram for illustrating a detailed configuration of a delay mechanism which a variable valve operating apparatus for an internal combustion engine according to a fifth embodiment of the present invention.

It is assumed that a variable valve operating apparatus 140 according to the present embodiment is configured in the same manner as the variable valve operating apparatus 100 according to the third embodiment described above, except that the configuration of a delay mechanism 142 differs as shown in FIG. 21 described later.

The delay mechanism 132 of the fourth embodiment described above is arranged such that the axial position of the second link shaft 106*b* is held using the actions of the tapered surfaces 134*a* and 136*a* during performance of the valve stop control. However, there is a possibility that sliding arises between the tapered surfaces 134*a* and 136*a* in such arrangement, and, as a result, it may result in a case in which the axial position of the second link shaft 106*b* can not be held satisfactorily. Accordingly, in order to resolve such problem, the variable valve operating apparatus 140 of the present embodiment includes a delay mechanism 142 having the configuration shown in FIG. 21 described below.

FIG. 21 is a diagram for illustrating a detailed configuration of the delay mechanism 142 which the variable valve operating apparatus 140 for an internal combustion engine according to the fifth embodiment of the present invention.

As shown in FIG. 21, in the peripheral surface of a rocker shaft 144, a crescent-shaped guide groove 144*a* is formed at a portion in the periphery of the end part of the second link shaft 106*b* side in the first link shaft 106*a*. A guide pin 146 that is displaced in synchronization with the first link shaft 106*a* is fitted into the guide groove 144*a*. More specifically, the guide pin 144*a* functions as a groove guiding the guide pin 146. The interrelationship among each component is specified in such a way that the guide pin 146 is positioned at one end 144*a*1 of the guide groove 144*a* when the first link shaft 106*a* is in the position at the time of the valve operating state (see FIG. 21(A)), and that the guide pin 146 is positioned at the remaining end 144*a*2 of the guide groove 144*a* when the first link shaft 106*a* is in the position at the valve stop state (see FIG. 21(B).

On the other hand, the third link arm 148 provided for #2 cylinder in the present embodiment is configured in the same manner as the third link arm 104 described above, except that an engagement groove 148*b* which is engaged with the guide pin 146 is formed in a bearing part 148*a* into which the rocker shaft 144 is inserted. Moreover, the third link arm 148 is integrally coupled with the second link shaft 106*b* via a press-fit pin which is not shown.

As shown in FIG. 21, the engagement groove 148*b* is formed into an L-shaped. One side of the L-shaped corresponds to a first groove part 148*b*1 that allows the axial displacement of the third link arm 148 with respect to the guide pin 146 and that, on the other hand, restricts the rotation of the third link arm 148 with respect to the guide pin 146. Moreover, the other side of the L-shaped corresponds to a second groove part 148*b*2 that allows the rotation of the third link arm 148 with respect to the guide pin 146 and that, on the other hand, restricts the axial displacement of the third link arm 148 with respect to the guide pin 146.

The guide groove 144*a* and engagement groove 148*b* formed described above function as grooves to rotate the third link arm 148 in such a way that a second projection part (not shown) of the third link arm 148 is engaged with the second guide rail 54#2 according to the displacement of the guide pin 146 associated with the displacement of the first link shaft 106*a*.

FIG. 21(A) shows the operational state of the delay mechanism 142 at the time of the valve operating state (initial state). In this initial state, the guide pin 146 is positioned at the one end 144*a*1 of the guide groove 144*a* and at the root part of the L-shaped of the engagement groove 148*b*.

If the energization of the electromagnetic solenoid 56 is performed in the initial state, the first projection part 46*b* of the first link arm 46 is engaged with the first guide rail 54#4 and the first link shaft 106*a* starts being displaced (slid). When the guide pin 146 is displaced in synchronization with the displacement of this first link shaft 106*a*, the guide pin 146 moves in the first groove part 148*b*1 of the engagement groove 148*b*. As already described, the first groove part 148*b*1 allows the axial displacement of the third link arm 148 with respect to the guide pin 146 and, on the other hand, restricts the rotation of the third link arm 148 with respect to the guide pin 146. In this case, the third link arm 148 is therefore rotated without being displaced in the axial direction as a result of the displacement of the guide pin 46 as shown in FIG. 21(B). As a result of that, the second projection part of the third link arm 148 is engaged with the second guide rail 54#2.

Thereafter, as a result of the engagement between the second projection part of the third link arm 148 and the second guide rail 54#2, the second link shaft 106*b* is displaced (slid) with the third link arm 148 as shown in FIG. 21(C). Then, when the sliding operation of the second link shaft 106*b* is terminated, the second projection part is taken out from the second guide rail 54#2 by the action of the shallow bottom part 54*c* of the guide rail 54#2 as shown in FIG. 21(D).

At the position at which the second link shaft 106*b* has been displaced as shown in FIG. 21(D), the second groove part 148*b*2 of the engagement groove 148*b* is engaged with the guide pin 146. In this state, the axial movement of the guide pin 146 is restricted by the first link shaft 106*a*, the axial position of which is held as a result of the notch part 46*d* of the first link arm 46 being engaged with the drive shaft 56*a* of the electromagnetic solenoid 56. As already described, the second groove part 148*b*2 allows the rotation of the third link arm 148 with respect to the guide pin 146 and, on the other hand, restricts the axial displacement of the third link arm 148 with respect to the guide pin 146. In this case, the axial displacements of the third link arm 148 and the second link shaft 106*b* coupled therewith are therefore restricted as a result of the second groove part 148*b*2 being engaged with the guide pin 146. That is to say, the axial position of the second link shaft 106*b* is held so that the second link shaft 106*b* is not returned to the position at the time of the valve operating state by itself by the biasing forces of the return springs 42 for #1 and 2 cylinders.

As described so far, the delay mechanism 142 of the present embodiment can convert, with a delay, the sliding force of the first link shaft 106*a* taking place during the engagement between the first projection part 46*b* and the first guide rail 54#4, into the rotational force of the third link arm 148 by the utilization of the actions of the guide grooves 144*a*, the guide pin 146 and the engagement groove 148*b*. More specifically, the third link arm 148 can be rotated with a delay with respect to the rotation of the first link arm 46 as a result of the energization of the electromagnetic solenoid 56. By the use of the arrangement described above, it is also made possible to increase the number of the guide rails 54 without increasing the number of the electromagnetic solenoids 56. Further, in the variable valve operating apparatus 140 that includes the single electromagnetic solenoid 56 and one guide rail 54 provided for each of both the cylinder groups, the operational states of the valves 26 for all cylinders can be switched collectively and smoothly from the valve operating state to the valve stop state, while reducing the contact loads between the respective guide rails 54#4, 54#2, and the projection part 46*b* and the like.

Furthermore, as shown in FIG. 21(D), by engaging the second groove part 148*b*2 of the engagement groove 148*b* with the guide pin 146 the axial position of which is restricted, the delay mechanism 142 which the above-described variable valve operating apparatus 140 includes can surely hold (lock) the axial position of the second link shaft 106*b* so as not to be returned to the position at the time of the valve operating state by itself during performance of the valve stop control.

It is noted that in the fifth embodiment, which has been described above, the second projection part (not shown) of the third link arm 148 corresponds to the "second engagement part" according to the above-described ninth aspect of the present invention; the third link arm 148 to the "second main displacement member" according to the above-described ninth aspect of the present invention; and the delay mechanism 142 to the "delay mechanism" according to the above-described ninth and eleventh aspects of the present invention, respectively.

Moreover, the second groove part 148*b*2 of the engagement groove 148*b* corresponds to "holding part" according to the above-described twelfth aspect of the present invention.

Sixth Embodiment

Next, a sixth embodiment of the present invention will be described with reference to FIG. 22.

Figure 22:
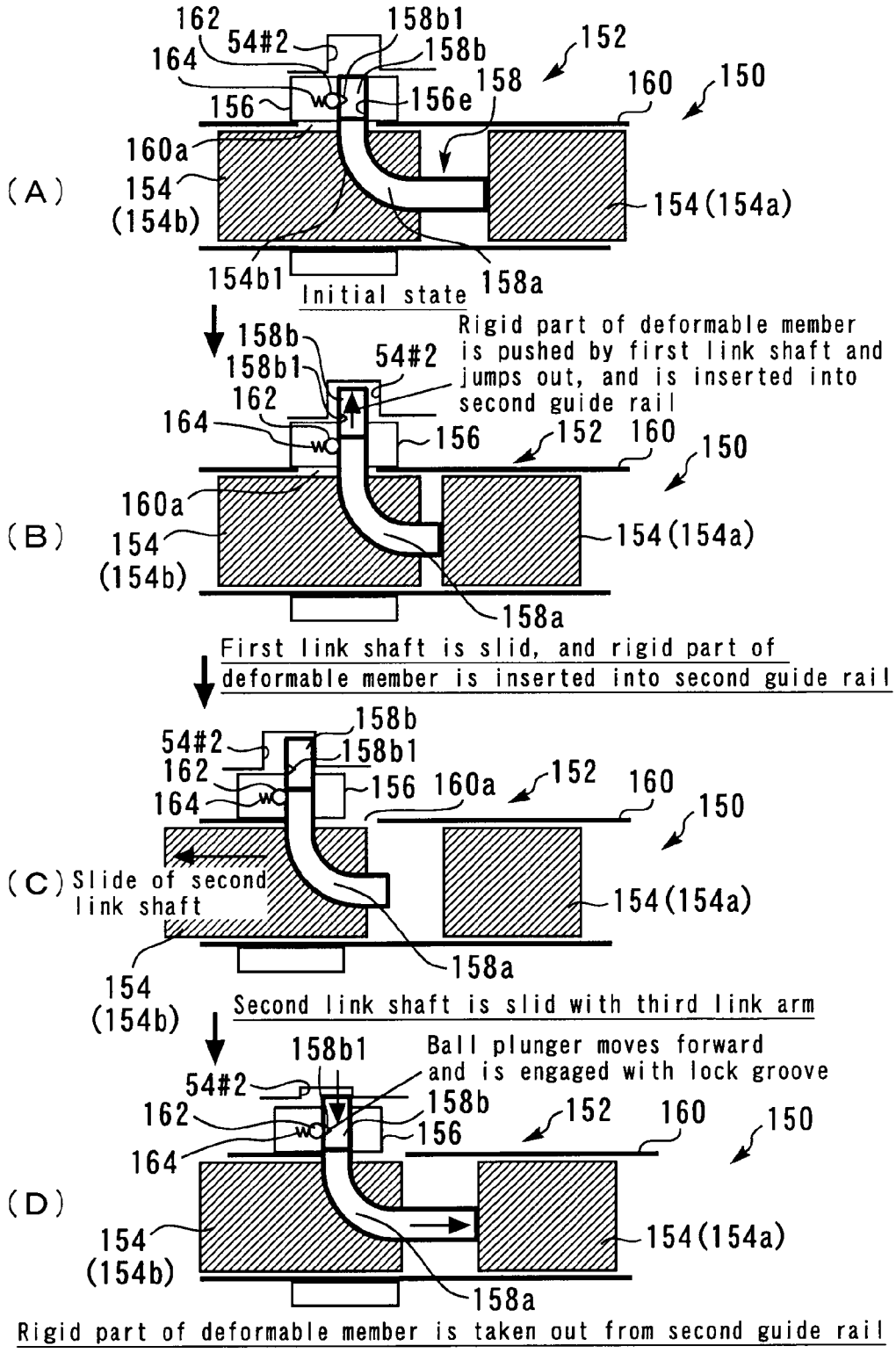
FIG. 22 is a diagram for illustrating a detailed configuration of a delay mechanism which a variable valve operating apparatus for an internal combustion engine according to a sixth embodiment of the present invention includes.

It is assumed that a variable valve operating apparatus 150 according to the present embodiment is configured in the same manner as the variable valve operating apparatus 100 according to the third embodiment described above, except that the configuration of a delay mechanism 152 differs as shown in FIG. 22 described later.

The delay mechanism 142 according to the above-described fifth embodiment makes it possible to surely hold (lock) the axial position of the second link shaft 106*b* during performance of the valve stop control. Such configuration, however, has a problem that a troublesome groove processing is required for the rocker shaft 144 and the third link arm 148. Accordingly, the variable valve operating apparatus 150 of the present embodiment includes a delay mechanism 152 having a configuration that can resolve such problem as shown in FIG. 22 below.

FIG. 22 is a diagram for illustrating a detailed configuration of the delay mechanism 152 which the variable valve operating apparatus 150 for an internal combustion engine according to the sixth embodiment of the present invention includes.

As shown in FIG. 22, the delay mechanism 152 includes a deformable member 158 having a flexible part (wire or the like) 158*a* that passes through insides of the second link shaft 154*b* and the third link arm 156 for #2 cylinder. At one end of the deformable member 158, a rigid part 158*b* is provided that functions as a second projection part of the third link arm 156 (second engagement part). Moreover, the remaining end of the deformable member 158 is disposed at a position that can abut on the end part of the second link shaft 154*b* side in the first link shaft 154*a*.

Moreover, as shown in FIG. 22, a through hole 154*b*1 into which the deformable member 158 is inserted is formed inside the second link shaft 154*b*. The through hole 154*b*1 functions as a groove that guides the deformable member 158 in order to convert the moving direction of the deformable member 158 from the axial direction of the first link shaft 154*a* into the axial direction of the second projection part (rigid part 158*b*) of the third link arm 156. The second link shaft 154*b* is integrally coupled with the third link arm 156 via a press-fit pin (not shown). Further, a through hole 156*e* into which the deformable member 158 is inserted is formed at a position corresponding to the through hole 154*b*1 of the second link shaft 154*b*. Furthermore, a relief hole 160*a* for allowing the movement of the deformable member 158 in synchronization with the second link shaft 154*b* is formed in the rocker shaft 160.

Furthermore, a ball plunger 162 is installed in the peripheral surface of the through hole 156*e* of the third link arm 156. The ball plunger 162 is biased toward the rigid part 158*b* of the deformable member 158 by a spring 164. A lock groove 158*b*1 that is engageable with the ball plunger 162 is formed on the rigid part 158*b*. The lock groove 158*b*1 is provided at a position that is engageable with the ball plunger 162 in the initial state shown in FIG. 22(A).

FIG. 22(A) shows the operational state of the delay mechanism 152 at the time of the valve operation state (initial state). In this initial state, the rigid part 158*b* is locked by the ball plunger 162 at a position that is not engaged with the second guide rail 54#2, and the remaining end of the deformable member 158 is abutment with the first link shaft 154*a*.

If the energization of the electromagnetic solenoid 56 is performed in the initial state, the first projection part 46*b* of the first link arm 46 is engaged with the first guide rail 54#4 and the first link shaft 154*a* starts being displaced (slid). As a result of this, as shown in FIG. 22(B), the deformable member 158 is displaced in synchronization with the displacement of the first link shaft 154*a*. Thereby, the engagement between the ball plunger 112 and the rigid part 158*b* is released, and the rigid member 158*b* that functions as the second projection part is engaged with the second guide rail 54#2.

Thereafter, as a result of the engagement between the second projection part (rigid part 158*b*) of the third link arm 156 and the second guide rail 54#2, the second link shaft 154*b* is displaced (slid) with the third link arm 156 as shown in FIG. 22(C). Then, when the sliding operation of the second link shaft 154*b* is terminated, the second projection part (rigid part 158*b*) is taken out from the second guide rail 54#2 by the action of the shallow bottom part 54*c* of the guide rail 54#2 as shown in FIG. 22(D). Moreover, when the second projection part (rigid part 158*b*) is taken out from the second guide rail 54#2 in this manner, the ball plunger 162 moves forward to be engaged with the lock groove 158*b*1 and the remaining end of the deformable member 158 comes into abutment with the end part of the first link shaft 154*a*.

As described so far, according to the delay mechanism 152 of the present embodiment, the deformable member 158 is displaced associated with the displacement of the first link shaft 154*a* taking place during the engagement between the first projection part 46*b* and the first guide rail 54#4, and thereby the second projection part (rigid part 158*b*) is engaged with the second guide rail 54#2. More specifically, the second projection part (rigid part 158*b*) operates to be engaged with the second guide rail 54#2 with a delay with respect to the start of the rotation of the first link arm 46 as a result of the energization of the electromagnetic solenoid 56. By the use of the arrangement described above, it is also made possible to increase the number of the guide rails 54 without increasing the number of the electromagnetic solenoids 56. Further, according to the configuration of the present embodiment, without having to have a groove that requires a troublesome groove processing as in the configuration of the fifth embodiment described above, the operational states of the valves 26 for all cylinders can be switched collectively and smoothly from the valve operating state to the valve stop state, while reducing the contact loads between the respective guide rails 54#4, 54#2, and the projection part 46*b*, 158*b* (rigid part), in the variable valve operating apparatus 150 that includes the single electromagnetic solenoid 56 and one guide rail 54 provided for each of both the cylinder groups. In further addition, the through hole 154*b*1 formed in the second link shaft 154*b* of the present embodiment just has to function as a passage of the deformable member 158. This allows a high processing accuracy not to be required compared with the configuration having the guide groove 144*a* and the engagement groove 148*b* of the above-described fifth embodiment.

Moreover, according to the delay mechanism 152 which the above-described variable valve operating apparatus 150 includes, in the state in which the second projection part (rigid part 158*b*) is taken out from the second guide rail 54#2, the ball plunger 162 is engaged with the lock groove 158*b*1 and the remaining end of the deformable member 158 comes into abutment with the end part of the first link shaft 154*a*. During performance of the valve stop control, the movement of the deformable member 158 is restricted by the ball plunger 162 being engaged with the lock groove 158*b*1, and the axial position of the first link shaft 154*a* is held by the notch part 46*d* of the first link arm 46 being engaged with the drive shaft 56*a* of the electromagnetic solenoid 56. Therefore, during performance of the valve stop control, by the deformable member 158 being abutment with the first link shaft 154*a*, the axial position of the second link shaft 106*b* can be surely held (locked) so as not to be returned to the position at the time of the valve operating state by itself by the biasing forces of the return springs 42 for #1 and #2 cylinders.

It is noted that in the sixth embodiment, which has been described above, the first link shaft 154*a* corresponds to the "first member connecting shaft" according to the above-described thirteenth aspect of the present invention; the second link shaft 154*b* to the "second member connecting shaft" according to the above-described thirteenth aspect of the present invention; the first projection part 46*b* to the "first engagement part" according to the above-described thirteenth aspect of the present invention; the first link arm 46 to the "first main displacement member" according to the above-described thirteenth aspect of the present invention; the second link arm 48 for #3 cylinder to the "first sub displacement member" according to the above-described thirteenth aspect of the present invention; the second projection part (rigid part) 158*b* to the "second engagement part" according to the above-described thirteenth aspect of the present invention; the third link arm 156 to the "second main displacement member" according to the above-described thirteenth aspect of the present invention; the second link arm 48 for #1 cylinder to the "second sub displacement member" according to the above-described thirteenth aspect of the present invention; and the delay mechanism 152 to the "delay mechanism" according to the above-described thirteenth aspect of the present invention, respectively.

Meanwhile, in the fourth to sixth embodiments, which have been described above, the description is made on the configuration of the delay mechanism 132, 142 or 152 that is applied to the configuration having the single electromagnetic solenoid 56 and the one guide rail 54 provided for each of both the cylinder groups. The configuration of such delay mechanism 132, 142 or 152, however, may be applied with respect to the configuration having the single electromagnetic solenoids 56 and the respective guide rail 54 provided for all cylinders, as shown in, for example, above FIG. 18.

The invention claimed is:

1. A variable valve operating apparatus for an internal combustion engine that has a first cylinder group made up of a plurality of cylinders lying side by side and a second cylinder group made up of another plurality of cylinders lying side by side, and has an explosion order which is set by a plurality of cams each corresponding to each cylinder of the first and second cylinder groups in such a way that a common base-circle section of the cams is present relating to the plurality of cylinders belonging to the first cylinder group and another common base-circle section of the cams is present relating to the another plurality of cylinders belonging to the second cylinder group, the variable valve operating apparatus comprising:

a plurality of transfer members which are disposed between each cam and a valve in each cylinder of the first and second cylinder groups, and transfer an acting force of each cam to the respective valve; and a changeover mechanism which changes operational states of the transfer members to switch operating characteristics of the valves, wherein the changeover mechanism includes:

an actuator which is shared by the cylinders of the first and second cylinder groups, and is driven when the operational states of the transfer members are switched;

a guide rail which is of helical shape and is provided in an outer peripheral surface of a camshaft to which the cams are attached;

a rigid member which is displaced when being engaged with the guide rail as a result of an actuation of the actuator to switch the operational states of the transfer members; and a delay mechanism which delays a displacement of the rigid member in the cylinder in which the valve is lifting when the actuator is actuated, wherein the delay mechanism is interposed at some point in the rigid member between the first cylinder group and the second cylinder group, wherein each transfer member includes first and second rocker arms, and the first rocker arm oscillates in synchronization with the respective cam and the second rocker arm which can press the respective valve, wherein the rigid member includes:

a member connecting shaft which is disposed inside a rocker shaft supporting the first and second rocker arms in such a way as to be displaceable in its axial direction; and a plurality of displacement members provided for each cylinder of the first and second cylinder groups, each displacement member is connected to the member connecting shaft, and is displaced along with the member connecting shaft as a result of an actuation of the actuator to change the operational states of the second rocker arm for the respective cylinder, and wherein the delay mechanism is interposed at some point in the member connecting shaft inside the rocker shaft.

2. The variable valve operating apparatus for an internal combustion engine according to claim 1, wherein the variable valve operating apparatus further comprises a changeover pin for each displacement member which is disposed so as to be movable with respect to a pin hole formed in each of the first and second rocker arms of the respective displacement member, and which is displaced in conjunction with a displacement of the respective displacement member, and wherein the displacement of each displacement member switches between a connection state in which the respective first and second rocker arms are in connection via the changeover pin and a disconnection state in which the connection is released.

3. The variable valve operating apparatus for an internal combustion engine according to claim 1, wherein each displacement member is one of either:

a main displacement member which has an engaging part engageable and disengageable with the guide rail, and is displaceable in the axial direction of the camshaft; or a sub displacement member which is displaced in conjunction with the main displacement member via the member connecting shaft, wherein the actuator generates a driving force for engaging the engaging part with the guide rail, wherein when the actuator is actuated, the engaging part is engaged with the guide rail as a result of the main displacement member being rotated about the member connecting shaft, and wherein the operational states of the respective second rocker arm for the cylinder for which the main displacement member is provided are changed as a result of a displacement of the main displacement member that takes place during engagement between the engaging part and the guide rail, and the operational states of the respective second rocker arm for the cylinders for which the sub displacement member is provided are changed as a result of displacements of the member connecting shaft and the sub displacement member in conjunction with the displacement of the main displacement member.

4. The variable valve operating apparatus for an internal combustion engine according to claim 2, wherein the variable valve operating apparatus switches the respective first and second rocker arms from the connection state to the disconnection state as a result of the respective displacement member, which abuts on the changeover pin, pressing the changeover pin, wherein the variable valve operating apparatus further comprises a biasing device for each displacement member which biases at least one of the member connecting shaft and the respective displacement member toward a direction to return to the connection state, wherein at a time of a return to the connection state, the actuator is driven to release a state in which the member connecting shaft and the respective displacement member are held so as not to be displaced by a biasing force generated by the biasing device, and wherein the variable valve operating apparatus further comprises a restricting device which restricts a displacement of the member connecting shaft in such a way that when the actuator is actuated to return to the connection state, the operational states of the first and second rocker arms corresponding to at least one of the cylinders are not returned to the connection state before the operational states of the first and second rocker arms in a return start target cylinder to the connection state are returned to the connection state.

5. The variable valve operating apparatus for an internal combustion engine according to claim 4, wherein the restricting device is provided in a plurality of cylinders, which are cylinders except for the last cylinder in explosion order with respect to the return start target cylinder and in which the explosion order is successive.

6. The variable valve operating apparatus for an internal combustion engine according to claim 1, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein each displacement member is one of either:

a first main displacement member which has a first engagement part being engageable and disengageable with the first guide rail, is integrally coupled with the first member connecting shaft, and is rotatably supported by the rocker shaft;

a first sub displacement member which is displaced in conjunction with the first main displacement member via the first member connecting shaft;

a second main displacement member which has a second engagement part being engageable and disengageable with the second guide rail, is integrally coupled with the second member connecting shaft, and is rotatably supported by the rocker shaft; or a second sub displacement member which is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating with the member connecting shaft, wherein the operational states of the respective second rocker arm for the cylinder for which the first main displacement member is provided are changed as a displacement of the first main displacement member takes place during the engagement between the first engaging part and the first guide rail, and the operational states of the respective second rocker arm for the cylinders for which the first sub displacement member are provided are changed as displacements of the first member connecting shaft and the first sub displacement member in conjunction with the displacement of the first main displacement member, wherein the delay mechanism is a mechanism which transfers a rotational force of the first member connecting shaft taking place during the engagement between the first engaging part and the first guide rail, into the second member connecting shaft with a delay, wherein when the rotational force of the first member connecting shaft is transferred into the second member connecting shaft via the delay mechanism, the second engagement part engages with the second guide rail as a result of a rotation of the second main displacement member with the second member connecting shaft, and wherein the operational states of the respective second rocker arm for the cylinder for which the second main displacement member is provided are changed as a displacement of the second main displacement member takes place during the engagement between the second engaging part and the second guide rail, and the operational states of the respective second rocker arm for the cylinders for which the second sub displacement member is provided are changed as displacements of the second member connecting shaft and the second sub displacement member in conjunction with the displacement of the second main displacement member.

7. The variable valve operating apparatus for an internal combustion engine according to claim 6, wherein the delay mechanism includes a torsion spring for transferring the rotational force of the first member connecting shaft into the second member connecting shaft with a delay.

8. A variable valve operating apparatus for an internal combustion engine that has a first cylinder group made up of a plurality of cylinders lying side by side and a second cylinder group made up of another plurality of cylinders lying side by side, and has an explosion order which is set by a plurality of cams each corresponding to each cylinder of the first and second cylinder groups in such a way that a common base-circle section of the cams is present relating to the plurality of cylinders belonging to the first cylinder group and another common base-circle section of the cams is present relating to the another plurality of cylinders belonging to the second cylinder group, the variable valve operating apparatus comprising:

a plurality of transfer members which are disposed between each cam and a valve in each cylinder of the first and second cylinder groups, and transfer an acting force of each cam to the respective valve; and a changeover mechanism which changes operational states of the transfer members to switch operating characteristics of the valves, wherein the changeover mechanism includes:

an actuator which is shared by the cylinders of the first and second cylinder groups, and is driven when the operational states of the transfer members are switched;

a guide rail which is of helical shape and is provided in an outer peripheral surface of a camshaft to which the cams are attached;

a rigid member which is displaced when being engaged with the guide rail as a result of an actuation of the actuator to switch the operational states of the transfer members; and a delay mechanism which delays a displacement of the rigid member in the cylinder in which the valve is lifting when the actuator is actuated, wherein the delay mechanism is interposed at some point in the rigid member between the first cylinder group and the second cylinder group, wherein each transfer member includes first and second rocker arms the first rocker arm oscillates in synchronization with the respective cam and the second rocker arm which can press the respective valve, wherein the rigid member includes:

a member connecting shaft which is disposed inside a rocker shaft supporting the first and second rocker arms in such a way as to be displaceable in its axial direction; and a plurality of displacement members provided for each cylinder of the first and second cylinder groups, each displacement member is connected to the member connecting shaft, and is displaced along with the member connecting shaft as a result of an actuation of the actuator to change the operational states of the second rocker arm for the respective cylinder, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein each displacement member is one of either:

a first main displacement member which has a first engagement part being engageable and disengageable with the first guide rail, and is rotatably supported by the rocker shaft;

a first sub displacement member which is displaced in conjunction with the first main displacement member via the first member connecting shaft;

a second main displacement member which has a second engagement part being engageable and disengageable with the second guide rail, and is rotatably supported by the rocker shaft; or a second sub displacement member which is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating, wherein the operational states of the respective second rocker arm for the cylinder for which the first main displacement member is provided are changed as a displacement of the first main displacement member takes place during the engagement between the first engaging part and the first guide rail, and the operational states of the respective second rocker arm for the cylinders for which the first sub displacement member is provided are changed as displacements of the first member connecting shaft and the first sub displacement member in conjunction with the displacement of the first main displacement member, wherein the delay mechanism is a mechanism which rotates the second main displacement member by use of the displacement of the first member connecting shaft taking place during the engagement between the first engaging part and the first guide rail and thereby rotates the second main displacement member at a timing later than that at the first main displacement member, wherein when the second main displacement member is rotated, the second engagement part is engaged with the second guide rail, and wherein the operational states of the respective second rocker arm for the cylinder for which the second main displacement member is provided are changed as a displacement of the second main displacement member takes place during the engagement between the second engaging part and the second guide rail, and the operational states of the respective second rocker arm for the cylinders for which the second sub displacement member is provided are changed as displacements of the second member connecting shaft and the second sub displacement member in conjunction with the displacement of the second main displacement member.

9. The variable valve operating apparatus for an internal combustion engine according to claim 8, wherein the delay mechanism includes:

a first tapered surface which is formed on the first member connecting shaft or a first fixing member fixed thereto in such a way that its width narrows toward the second main displacement member side; and a second tapered surface which is formed on the second main displacement member or a second fixing member fixed thereto and abuts on the first tapered surface, and wherein as the first tapered surface is displaced toward the second tapered surface as a result of the displacement of the first member connecting shaft, the first tapered surface presses the second tapered surface to rotate the second main displacement member.

10. The variable valve operating apparatus for an internal combustion engine according to claim 8, wherein the delay mechanism includes:

a guide pin which is displaced in conjunction with the first member connecting shaft;

a guide groove which is formed in a peripheral surface of the rocker shaft and guides the guide pin; and an engagement groove which is formed in the second main displacement member and is engaged with the guide pin, and wherein the guide groove and the engagement groove are grooves that function in order to rotate the second main displacement member as a result of a displacement of the guide pin associated with the displacement of the first member connecting shaft.

11. The variable valve operating apparatus for an internal combustion engine according to claim 10, wherein a holding part of the engagement groove is engaged with the guide pin at a position at which the second member connecting shaft has been displaced during the engagement between the second engagement part and the second guide rail, and thereby an axial position of the second member connecting shaft is held.

12. The variable valve operating apparatus for an internal combustion engine according to claim 1, wherein the guide rail includes a first guide rail which is disposed corresponding to the first cylinder group, and a second guide rail which is disposed corresponding to the second cylinder group, wherein the member connecting shaft is separated into a first member connecting shaft for the first cylinder group and a second member connecting shaft for the second cylinder group via the delay mechanism, wherein each displacement member is either one of:

a first main displacement member which has a first engagement part being engageable and disengageable with the first guide rail, and is rotatably supported by the rocker shaft;

a first sub displacement member which is displaced in conjunction with the first main displacement member via the first member connecting shaft;

a second main displacement member which has a second engagement part being engageable and disengageable with the second guide rail, and is rotatably supported by the rocker shaft; or a second sub displacement member which is displaced in conjunction with the second main displacement member via the second member connecting shaft, wherein the actuator produces a driving force to engage the first engagement part with the first guide rail, wherein when the actuator is actuated, the first engagement part is engaged with the first guide rail as a result of the first main displacement member rotating, wherein the operational states of the respective second rocker arm for the cylinder for which the first main displacement member is provided are changed as a displacement of the first main displacement member takes place during the engagement between the first engaging part and the first guide rail, and the operational states of the respective second rocker arm for the cylinders for which the first sub displacement member is provided are changed as displacements of the first member connecting shaft and the first sub displacement member in conjunction with the displacement of the first main displacement member, wherein the delay mechanism includes a deformable member, a first end of which functions as the second engagement part of the second main displacement member, a second end of which is abuttable with the first member connecting shaft, and which has a flexible part that passes through insides of the second member connecting shaft and the second main displacement member, wherein the deformable member is displaced as a result of the displacement of the first member connecting shaft taking place during the engagement between the first engaging part and the first guide rail, and thereby the second engagement part is engaged with the second guide rail at a timing later than a timing when the first engagement part is engaged with the first guide rail, and wherein the operational states of the respective second rocker arm for the cylinder for which the second main displacement member is provided are changed as a displacement of the second main displacement member takes place during the engagement between the second engaging part and the second guide rail, and the operational states of the respective second rocker arm for the cylinders for which the second sub displacement member is provided are changed as displacements of the second member connecting shaft and the second sub displacement member in conjunction with the displacement of the second main displacement member.

13. The variable valve operating apparatus for an internal combustion engine according to claim 12, wherein the variable valve operating apparatus of the internal combustion engine further comprises:

a ball plunger which is provided inside the second main displacement member; and a lock groove which is provided on the deformable member and is engageable with the ball plunger, and wherein in a state in which the second engagement part is taken out from the second guide rail after the displacement of the second member connecting shaft as a result of the engagement between the second engagement part and the second guide rail is performed, the ball plunger is engaged with the lock groove and the second end of the deformable member abuts on the first member connecting shaft, and thereby an axial position of the second member connecting shaft is held.

* * * * *

UNITED STATES PATENT AND TRADEMARK OFFICE

CERTIFICATE OF CORRECTION

PATENT NO. : 8,925,504 B2
APPLICATION NO. : 13/389540
DATED : January 6, 2015
INVENTOR(S) : Motohiro Tsuzuki et al.

It is certified that error appears in the above-identified patent and that said Letters Patent is hereby corrected as shown below:

On the Title page, Item 75, the 2nd Inventor's City of Residence is incorrect. Item 75 should read:

-- (75) Inventors: Motohiro Tsuzuki, Nisshin (JP);
Shinobu Shimasaki, Toyota (JP);
Akio Kidooka, Ashigarakami-gun (JP);
Hirotaka Sunada, Nagoya (JP) --

Signed and Sealed this
Nineteenth Day of May, 2015

Michelle K. Lee

Michelle K. Lee
*Director of the United States Patent and Trademark Office*